US010599091B2

(12) United States Patent
Kikura et al.

(10) Patent No.: US 10,599,091 B2
(45) Date of Patent: Mar. 24, 2020

(54) CABINET, ELECTRONIC DEVICE, AND IMAGE FORMING APPARATUS

(71) Applicants: Makoto Kikura, Kanagawa (JP); Yoshihide Ohta, Tokyo (JP); Shoji Asanuma, Kanagawa (JP); Gakushi Tanaka, Kanagawa (JP); Tomoya Tanaka, Kanagawa (JP); Akimitsu Obana, Kanagawa (JP); Taiga Shoen, Kanagawa (JP)

(72) Inventors: Makoto Kikura, Kanagawa (JP); Yoshihide Ohta, Tokyo (JP); Shoji Asanuma, Kanagawa (JP); Gakushi Tanaka, Kanagawa (JP); Tomoya Tanaka, Kanagawa (JP); Akimitsu Obana, Kanagawa (JP); Taiga Shoen, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/217,367

(22) Filed: Dec. 12, 2018

(65) Prior Publication Data

US 2019/0227478 A1 Jul. 25, 2019

(30) Foreign Application Priority Data

Jan. 23, 2018 (JP) ..... 2018-009146

(51) Int. Cl.
*G03G 21/16* (2006.01)
*B41J 29/13* (2006.01)

(52) U.S. Cl.
CPC ..... *G03G 21/1633* (2013.01); *B41J 29/13* (2013.01)

(58) Field of Classification Search
CPC .. G03G 21/1633; B41J 29/13; Y10T 70/5097; Y10T 70/5124
See application file for complete search history.

(56) References Cited

U.S. PATENT DOCUMENTS

2013/0287434 A1* 10/2013 Hisano ..... G03G 21/1619 399/110
2017/0060078 A1* 3/2017 Uohashi ..... G03G 21/1633
2017/0255159 A1* 9/2017 Inada ..... G03G 21/1633

FOREIGN PATENT DOCUMENTS

JP 8-248713 9/1996
JP 2009-271408 11/2009
(Continued)

*Primary Examiner* — Sandra Brase
(74) *Attorney, Agent, or Firm* — Harness, Dickey & Pierce, P.L.C.

(57) ABSTRACT

A cabinet includes a first body side engagement and a second body side engagement mounted on a body and a first cover side engagement and a second cover side engagement mounted on a cover. Slide restriction faces of the first cover side engagement and the second cover side engagement come into contact with slide restriction faces of the first body side engagement and the second body side engagement, respectively, to restrict sliding of a slider when the first cover side engagement does not engage the first body side engagement. The slide restriction face of at least one of the first body side engagement and the first cover side engagement has a length that is greater than a length of the slide restriction face of other one of the first body side engagement, the first cover side engagement, the second body side engagement, and the second cover side engagement.

15 Claims, 23 Drawing Sheets

(56) References Cited

FOREIGN PATENT DOCUMENTS

| | | |
|---|---|---|
| JP | 2010-197895 | 9/2010 |
| JP | 2011-053333 | 3/2011 |
| JP | 2012-163727 | 8/2012 |
| JP | 2013-057968 | 3/2013 |

* cited by examiner

| FIG. 10A | FIG. 10B |
|---|---|

| |
|---|
| FIG. 19A |
| FIG. 19B |

CABINET, ELECTRONIC DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-009146, filed on Jan. 23, 2018, in the Japan Patent Office, the entire disclosure of which is hereby incorporated by reference herein.

BACKGROUND

Technical Field

Exemplary aspects of the present disclosure relate to a cabinet, an electronic device, and an image forming apparatus, and more particularly, to a cabinet incorporating a cover that is openable and closable, an electronic device incorporating the cabinet, and an image forming apparatus incorporating the electronic device.

Discussion of the Background Art

Related-art cabinets include a body and an opening-closing cover that is openable and closable with respect to the body. When the opening-closing cover is closed, a cover side engagement mounted on the opening-closing cover engages a body side engagement mounted on the body to restrict opening of the opening-closing cover. The cabinets further include a slider mounting two hooks serving as two cover side engagements. As the slider slides in an engagement direction with respect to the opening-closing cover, the two hooks engage two holes serving as two body side engagements disposed in the body, respectively.

With the configuration of the cabinets in which the two cover side engagements engage the two body side engagements, respectively, although one of the two cover side engagements does not engage the body side engagement while another one of the two cover side engagements does, the opening-closing cover retains being closed with half closing.

In order to prevent half closing, that is, coupling the hook with the hole at one end of the opening-closing cover, solely when both hooks are ready to couple with the corresponding holes, respectively, a coupler couples both hooks with the corresponding holes, respectively.

However, the coupler has a complex mechanism incorporating lots of elements such as a collar and a torsion spring.

SUMMARY

This specification describes below an improved cabinet. In one embodiment, the cabinet includes a body and an opening-closing cover that opens and closes with respect to the body in an open-close direction. A first engagement assembly includes a first body side engagement that is disposed on the body and includes a slide restriction face. A first cover side engagement is disposed on the opening-closing cover and engages the first body side engagement. The first cover side engagement includes a slide restriction face. A second engagement assembly includes a second body side engagement that is disposed on the body and includes a slide restriction face. A second cover side engagement is disposed on the opening-closing cover and engages the second body side engagement. The second cover side engagement includes a slide restriction face. A slider mounts the first cover side engagement and the second cover side engagement and slides with respect to the opening-closing cover in an engagement direction so as to engage the first cover side engagement and the second cover side engagement with the first body side engagement and the second body side engagement, respectively.

The slide restriction faces of the first cover side engagement and the second cover side engagement come into contact with the slide restriction faces of the first body side engagement and the second body side engagement, respectively, to restrict sliding of the slider in the engagement direction when the first cover side engagement is not at a position where the first cover side engagement engages the first body side engagement in the open-close direction.

The slide restriction face of at least one of the first body side engagement and the first cover side engagement has a length in the open-close direction that is greater than a length of the slide restriction face of other one of the first body side engagement, the first cover side engagement, the second body side engagement, and the second cover side engagement.

This specification further describes an improved electronic device. In one embodiment, the electronic device includes an electronic part and the cabinet described above that covers the electronic part.

This specification further describes an improved image forming apparatus. In one embodiment, the image forming apparatus includes an image forming device that forms an image on a recording medium and the cabinet described above that covers the image forming device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
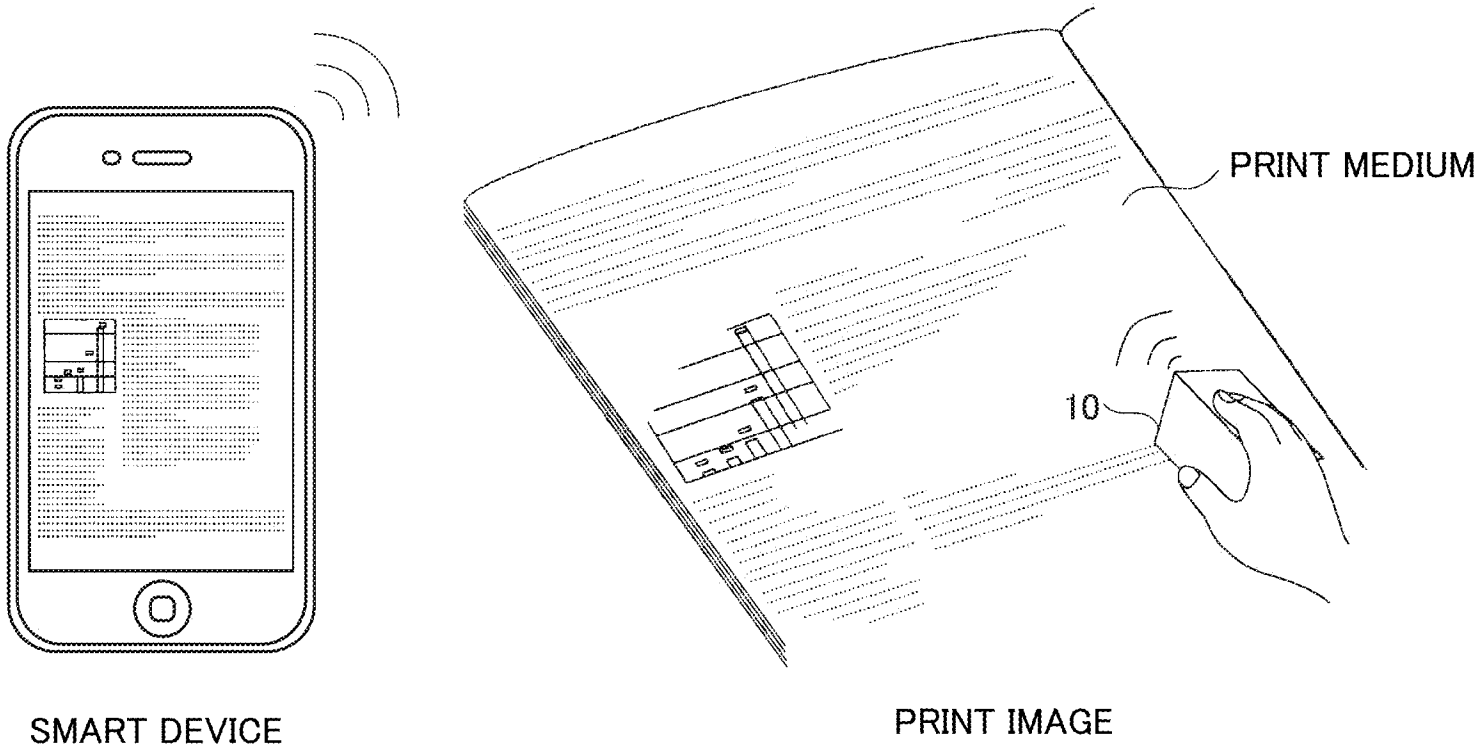
FIG. 1 is a perspective view of a printer according to an embodiment of the present disclosure, illustrating an exterior of the printer.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, a printer 100 according to an embodiment is explained.

FIG. 1 illustrates the printer 100 serving as an image forming apparatus. The image forming apparatus may be a copier, a facsimile machine, a printer, a multifunction peripheral or a multifunction printer (MFP) having at least two of copying, printing, scanning, facsimile, and plotter functions, or the like.

A description is provided below of an electrophotographic printer, hereinafter referred to as a printer, which forms an image by an electrophotographic method, as an image forming apparatus that employs a cabinet according to this disclosure.

FIG. 1 is a perspective view of the printer 100 according to this embodiment, illustrating an exterior of the printer 100.

As illustrated in FIG. 1, the printer 100 includes a body 20, a sheet ejection tray 29, and a control panel 14. The sheet ejection tray 29 and the control panel 14 are disposed on an upper face of the body 20. The printer 100 further includes a sheet feeding tray 1 (e.g., a paper tray), a front cover 50 serving as an opening-closing cover, and a bypass sheet feeding tray 3, which are disposed on a front face of the body 20. The printer 100 further includes a front cover release button 15 disposed on a right side face of the body 20.

Figure 2:
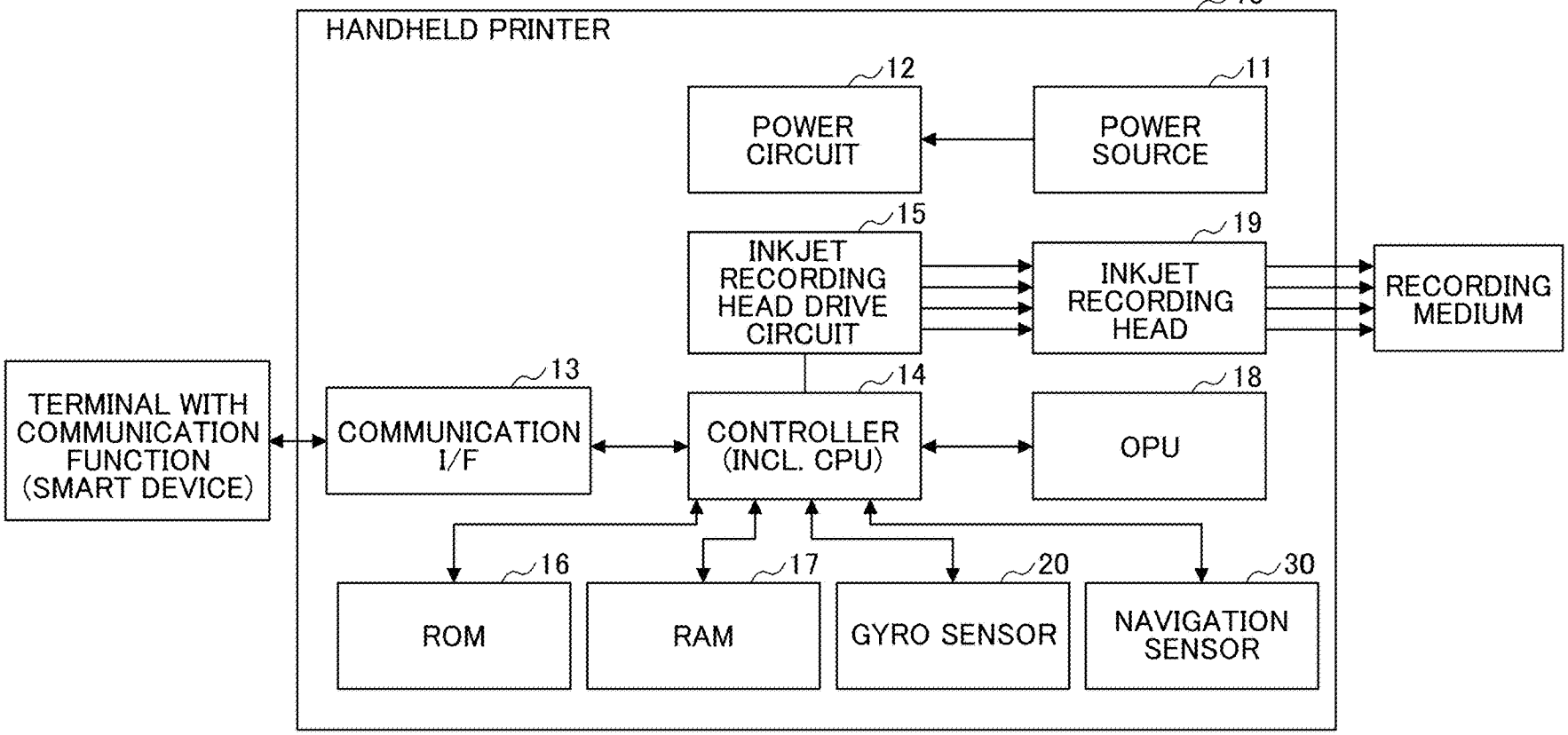
FIG. 2 is a schematic cross-sectional view of the printer depicted in FIG. 1.

FIG. 2 is a schematic cross-sectional view of the printer 100 according to this embodiment. The printer 100 further includes a photoconductor 6 serving as a latent image bearer, an image forming device 7 that forms a toner image on a surface of the photoconductor 6, a transfer device 8 that transfers the toner image formed on the surface of the photoconductor 6 onto a sheet P, and a fixing device 9 that fixes the toner image transferred onto the sheet P thereon. Those elements construct an image forming section 70 that forms an image on the sheet P serving as a recording medium.

The printer 100 further includes a sheet feeding device 200 disposed below the image forming section 70. The sheet feeding device 200 includes the sheet feeding tray 1 serving as a recording medium container that contains a sheaf of sheets P and a sheet feeding roller 2 serving as a sheet feeder that conveys the sheet P placed on the sheet feeding tray 1.

The printer 100 further includes a bypass sheet feeding device 300 disposed on the right of the image forming section 70 in FIG. 2. The bypass sheet feeding device 300 includes the bypass sheet feeding tray 3 placed with a sheet P manually, and a bypass sheet feeding roller 4 and an opposed roller 41 that convey the sheet P placed on the bypass sheet feeding tray 3.

The printer 100 further includes a photoconductor unit 40 disposed inside the body 20. The image forming device 7, including a developing device, a charger, and a toner container, and the photoconductor 6 are combined into the photoconductor unit 40. The photoconductor unit 40 is detachably attached to the body 20.

A description is provided of image formation performed by the printer 100.

An exposure device of the image forming device 7 forms a latent image on the surface of the photoconductor 6. The developing device of the image forming device 7 develops the latent image formed on the surface of the photoconductor 6 into a toner image thereon.

In order to form the toner image on sheets P stored on the sheet feeding tray 1, the sheet feeding roller 2 conveys the sheets P one by one to a sheet conveyance path 21 through which the sheet P is conveyed to a position where the sheet P strikes a registration roller pair 5.

In order to form the toner image on sheets P placed on the bypass sheet feeding tray 3, the bypass sheet feeding roller 4 conveys the sheets P one by one to the position where the sheet P strikes the registration roller pair 5.

The registration roller pair 5 is driven and rotated to convey the sheet P to a transfer position disposed opposite the transfer device 8 at a time when the toner image formed on the surface of the photoconductor 6 reaches the transfer position. The transfer device 8 transfers the toner image formed on the surface of the photoconductor 6 onto a surface of the sheet P at the transfer position. The fixing device 9 fixes the toner image on the sheet P under heat and pressure. The sheet P passes through a sheet ejector 10 and a sheet ejection roller pair 26 ejects the sheet P onto the sheet ejection tray 29 disposed outside the body 20.

A description is provided of operation of the bypass sheet feeding tray 3 and the front cover 50.

The bypass sheet feeding tray 3 is supported by the body 20 of the printer 100 through a tray pivot shaft 3*a* about which the bypass sheet feeding tray 3 is pivotable. A user presses down a bypass sheet feeding tray open button 31 depicted in FIG. 1 and pivots the bypass sheet feeding tray 3 in a direction A depicted in FIG. 2 to pull out the bypass sheet feeding tray 3 stored inside the body 20. Further, the user pulls out a tray extension 3*b* from the bypass sheet feeding tray 3 so that the user places the sheaf of sheets P thereon as illustrated in FIG. 2.

The printer 100 includes the front cover 50 serving as a front exterior cover of exterior covers of the cabinet. The front cover 50 is an exterior of a front, that is, a right side in FIG. 2, of the printer 100. The front cover 50 is supported by the body 20 through a cover pivot shaft 50*a* about which the front cover 50 is pivotable. The cover pivot shaft 50*a* is disposed in a lower end of the front cover 50 when the front cover 50 is closed.

Figure 3:
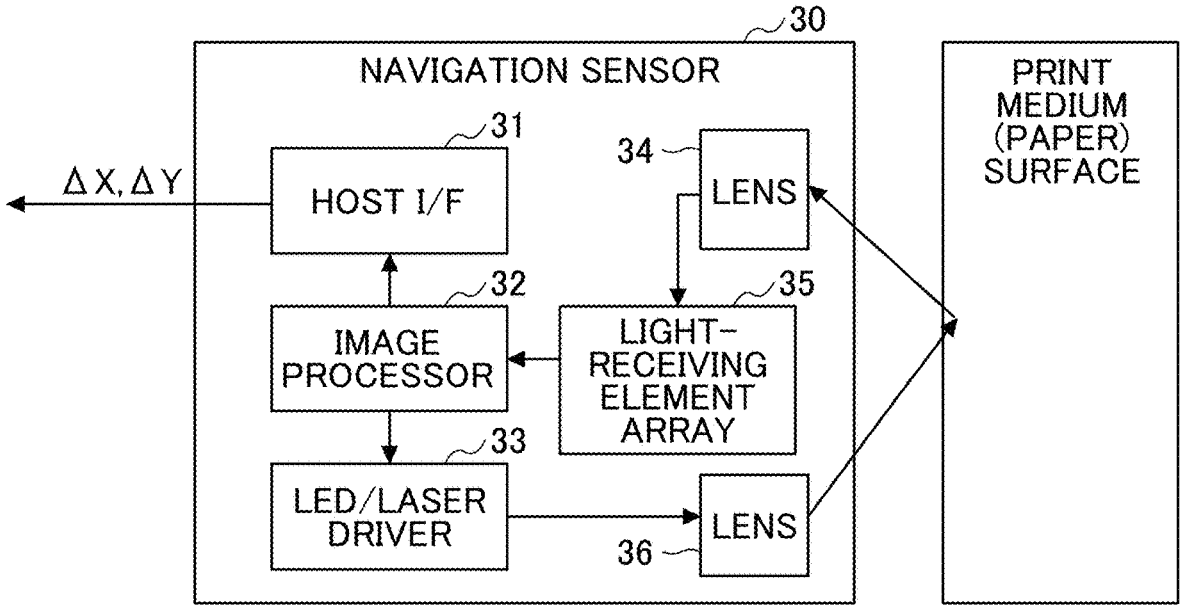
FIG. 3 is a schematic cross-sectional view of the printer depicted in FIG. 2, illustrating a front cover that is opened.

FIG. 3 is a schematic cross-sectional view of the printer 100, illustrating an open state of the front cover 50 in which the front cover 50 is opened after the user pivots the bypass sheet feeding tray 3 depicted in FIG. 2 in a direction opposite the direction A, stores the bypass sheet feeding tray 3 inside the front cover 50 stored inside the body 20, and pulls out the front cover 50. The bypass sheet feeding tray 3 is supported by the front cover 50 through the tray pivot shaft 3*a*. As illustrated in FIG. 3, as the user pivots the front cover 50, the bypass sheet feeding tray 3 pivots about the cover pivot shaft 50*a* together with the front cover 50.

As the user pivots the front cover 50 in a direction B1 depicted in FIG. 3 from a close state in which the front cover 50 is closed and covers the front of the printer 100 to the open state depicted in FIG. 3, a front opening 55, through which the user sees an inside of the printer 100, appears. As the user pulls out the photoconductor unit 40, into which the image forming device 7 and the photoconductor 6 are combined, through the front opening 55 to the front (e.g., the right side in FIG. 3) of the printer 100, the user removes the photoconductor unit 40 from the body 20.

A description is provided of attachment and detachment of the photoconductor unit 40.

Figure 4:
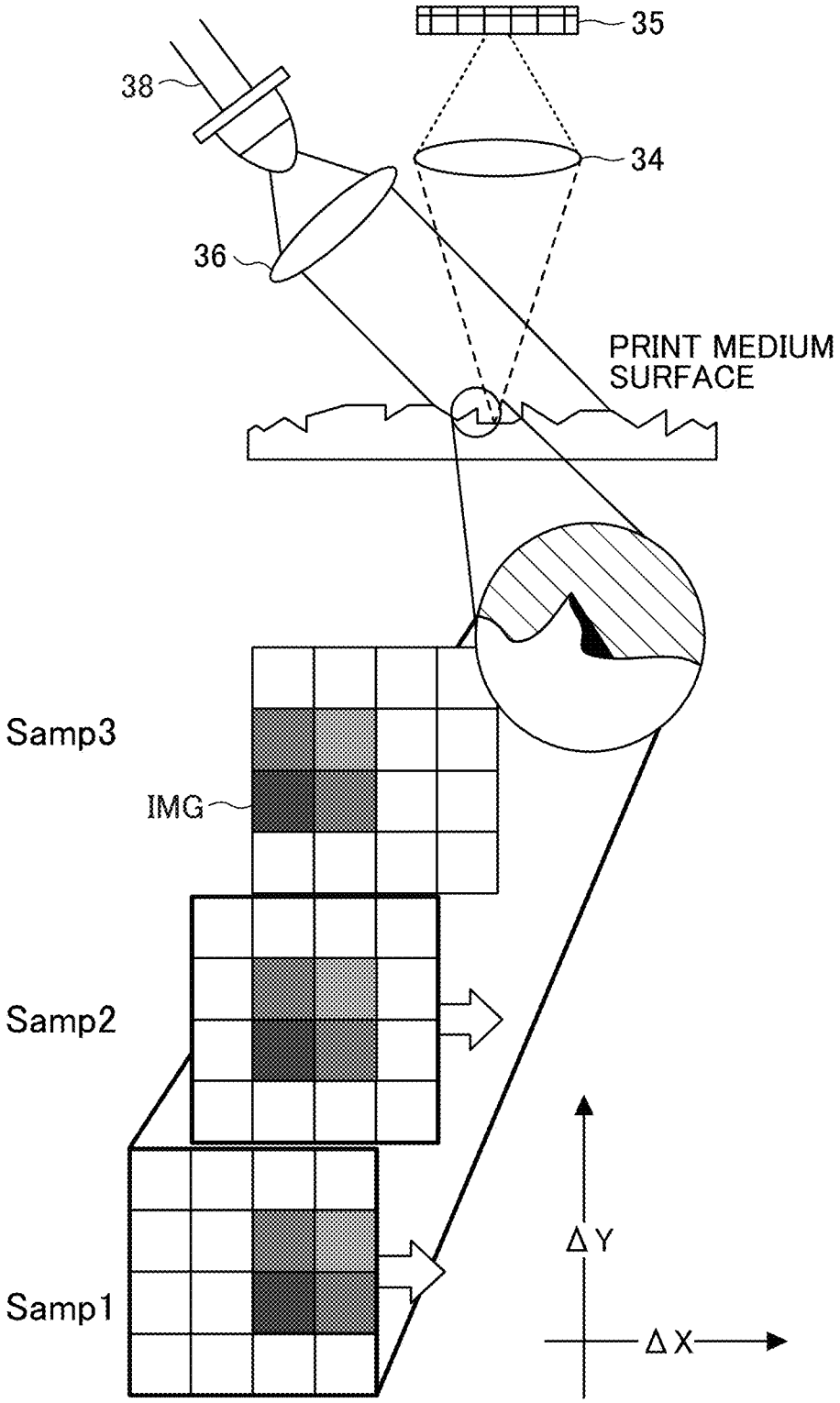
FIG. 4 is a perspective view of the printer depicted in FIG. 1, illustrating a photoconductor unit in a removal state in which the photoconductor unit is removed from a body of the printer and held by a hand of a user.

FIG. 4 is a perspective view of the printer 100, illustrating the photoconductor unit 40 in a removal state after a hand 60 of the user grips and removes the photoconductor unit 40 exposed through the front opening 55 from the body 20. While the front cover 50 is opened as illustrated in FIGS. 3 and 4, the user attachably detaches the photoconductor unit 40 from the body 20 as illustrated in FIG. 4.

Figure 5:
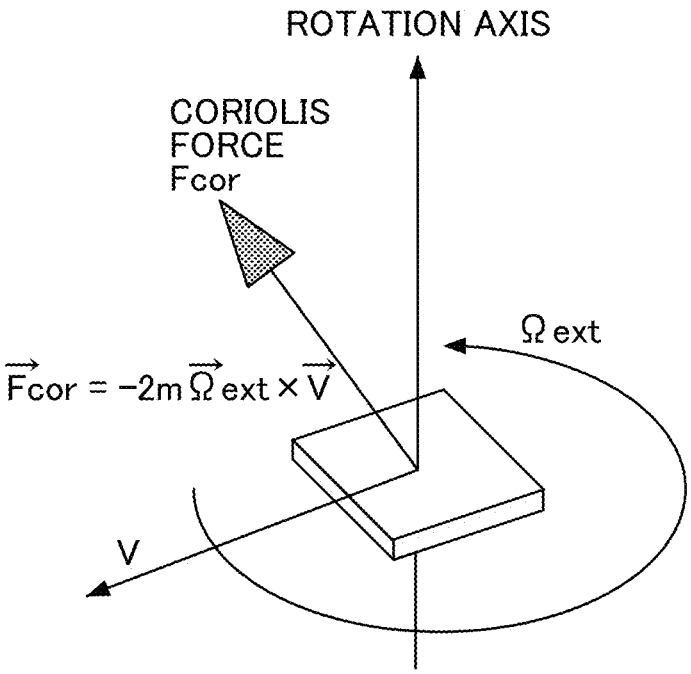
FIG. 5 is an enlarged perspective view of the printer depicted in FIG. 4, illustrating a vicinity of a front opening in an installation state in which the photoconductor unit is installed in the body after the removal state depicted in FIG. 4.

FIG. 5 is an enlarged perspective view of the printer 100, illustrating a vicinity of the front opening 55 in an installation state in which the photoconductor unit 40 is installed in the body 20 after the removal state depicted in FIG. 4. As the user pivots the front cover 50 in a direction B2 depicted in FIG. 5 with respect to the body 20, the front cover 50 closes in the close state.

A description is provided of a construction of a comparative example of the printer 100.

Figure 6:
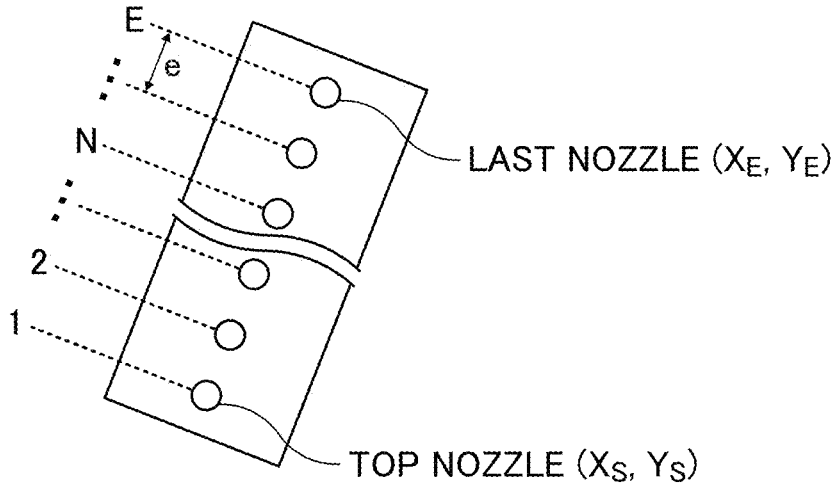
FIG. 6 (PRIOR ART)
FIG. 6 is a schematic top view of the printer depicted in FIG. 1 according to a comparative example.

FIG. 6 is a schematic top view of the printer 100 according to the comparative example that includes elements similar to elements of the printer 100 according to embodiments described below except for advantageous elements thereof. FIG. 6 illustrates the front cover 50 in the close state in which the front cover 50 covers the front of the printer 100.

As illustrated in FIG. 6, the front cover 50 mounts a rod type slider 11 that mounts two lock hooks, that is, a right lock hook 12*a*C and a left lock hook 12*b* which are disposed at two positions, that is, right and left of the rod type slider 11, respectively. As illustrated in FIG. 5, the rod type slider 11 is disposed at an opposite end of the front cover 50 that is opposite an end thereof where the front cover 50 is pivotable about the cover pivot shaft 50*a* with respect to the body 20, that is, at an upper end of the front cover 50 in the close state.

The rod type slider 11 is slidable with respect to the front cover 50 in a width direction (e.g., an axial direction of the cover pivot shaft 50*a* or a direction C depicted in FIG. 6) that is perpendicular to a moving direction of the front cover 50 that moves with respect to the body 20 when the front cover 50 opens and closes (e.g., a front-rear direction of the printer 100 immediately before the close state). The front cover 50 further mounts a spring 17 that biases the rod type slider 11 rightward in FIG. 6. As the rod type slider 11 slides, the two lock hooks, that is, the right lock hook 12*a*C and the left lock hook 12*b*, slide together with the rod type slider 11.

The body 20 includes a right wall 18*a* mounting a right hook receiver 13*a*C that catches and engages the right lock hook 12*a*C in the close state of the front cover 50. The body 20 further includes a left wall 18*b* mounting a left hook receiver 13*b* that catches and engages the left lock hook 12*b* in the close state of the front cover 50.

Figure 7:
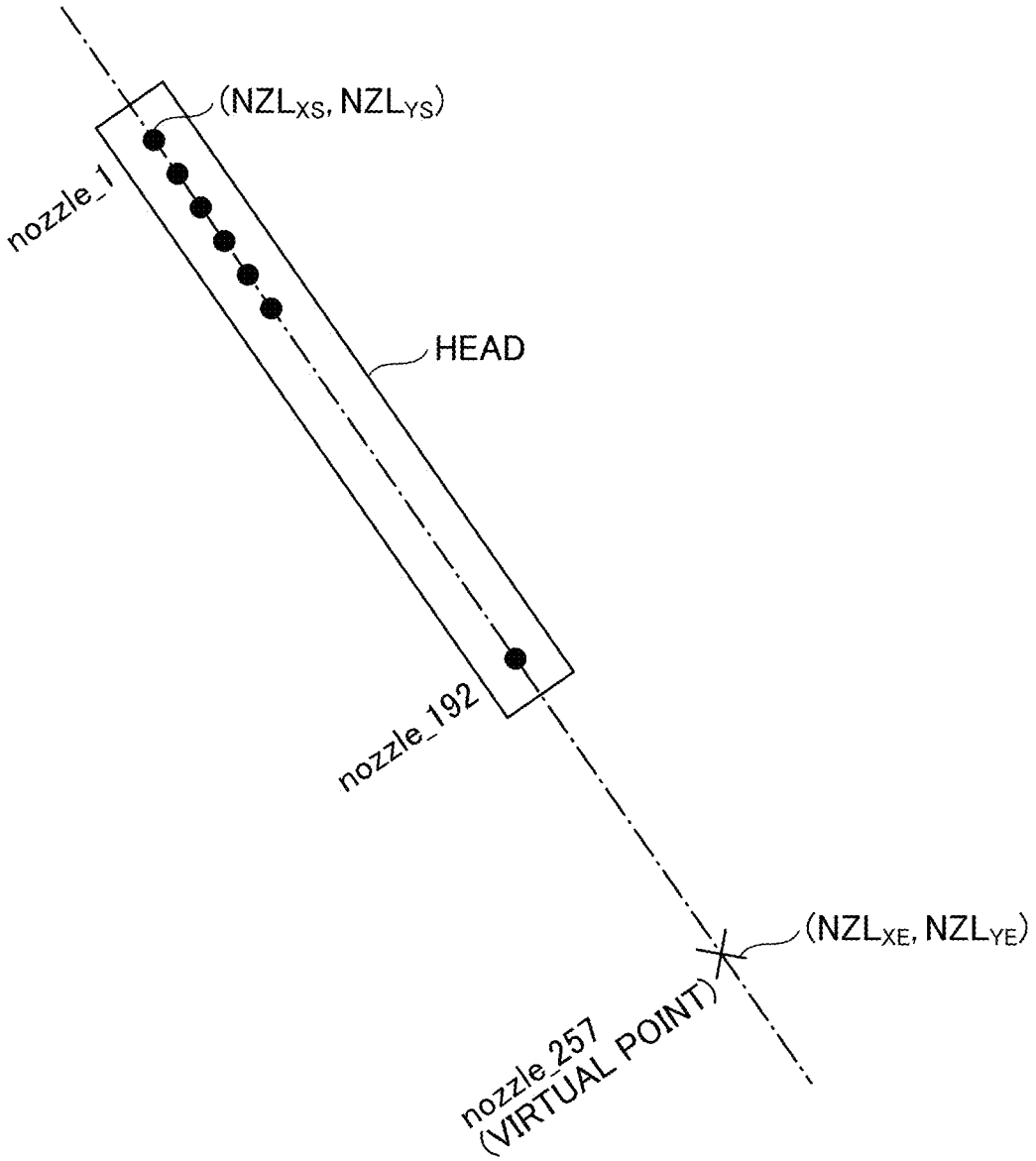
FIG. 7 (PRIOR ART)
FIG. 7 is an enlarged diagram of an engagement assembly incorporated in the printer depicted in FIG. 6.

FIG. 7 is an enlarged diagram of an engagement assembly 16 of the printer 100 according to the comparative example immediately before the close state. The engagement assembly 16 includes a lock hook 12 (e.g., the right lock hook 12*a*C and the left lock hook 12*b* depicted in FIG. 6) and a hook receiver 13 (e.g., the right hook receiver 13*a*C and the left hook receiver 13*b* depicted in FIG. 6). With the printer 100 according to the comparative example, as illustrated in FIG. 6, the right lock hook 12*a*C and the right hook receiver 13*a*C are similar to the left lock hook 12*b* and the left hook receiver 13*b* in shape. Hence, in FIG. 7 and descriptions below, suffixes "a" and "b" indicating right and left, respectively, are omitted.

As illustrated in FIG. 7, the hook receiver 13 includes a receiver side contact face 133 serving as a receiver side lock struck by a hook side contact face 124 when the lock hook 12 engages the hook receiver 13 for locking. The hook side contact face 124 is a part of a bent portion 125 of the lock hook 12, which bends rightward in FIG. 7 from a tip of the lock hook 12. The hook receiver 13 further includes a receiver side guide face 132, serving as a guide face of a receiver, which guides the lock hook 12 to the receiver side contact face 133 when the user closes the front cover 50.

The lock hook 12 includes the hook side contact face 124, serving as a lock of a hook, which strikes the receiver side contact face 133 when the lock hook 12 engages the hook receiver 13 for locking. The lock hook 12 includes a width direction motion guide face 122 and a hook side guide face 123, serving as two guide faces of a hook, which are contacted and guided by the hook receiver 13 when the hook side contact face 124 is guided to the receiver side contact face 133 as the user closes the front cover 50.

As the user pivots the front cover 50 in the open state in the direction B2 depicted in FIG. 5 to move the front cover 50 to the close state, immediately before the close state, the lock hook 12 moves toward the hook receiver 13 in the direction B2 as illustrated in FIG. 7. The width direction motion guide face 122 of the lock hook 12 comes into contact with a receiver tip corner 140 defined by a receiver tip face 131 and the receiver side guide face 132 of the hook receiver 13. Thereafter, as the user moves the front cover 50 to the close state, the lock hook 12 is applied with a force that moves the lock hook 12 leftward on the front of the printer 100 according to the comparative example along a slope of the width direction motion guide face 122.

As described above, the spring 17 depicted in FIG. 6 biases the rod type slider 11 mounting the lock hook 12 rightward in a width direction of the printer 100. As the width direction motion guide face 122 contacts the receiver tip corner 140 and the lock hook 12 is applied with the force that moves the lock hook 12 leftward on the front of the printer 100 along the tilt of the width direction motion guide face 122, the rod type slider 11 slides leftward in the width direction of the printer 100 against a bias from the spring 17.

When the user moves the front cover 50 further to the close state while the width direction motion guide face 122 contacts the receiver tip corner 140, the hook side guide face 123 of the lock hook 12 comes into contact with the receiver side guide face 132 of the hook receiver 13. In this state, the hook side guide face 123 of the lock hook 12 that is moved rightward in the width direction of the printer 100 by the bias from the spring 17 contacts the receiver side guide face 132 of the hook receiver 13.

While the hook side guide face 123 contacts the receiver side guide face 132, the lock hook 12 does not displace with respect to the hook receiver 13 in the width direction of the printer 100. The lock hook 12 moves in the moving direction of the front cover 50, that is, the direction B2 in FIG. 7.

When the hook side guide face 123 of the lock hook 12 passes the receiver side guide face 132, since the lock hook 12 is free from a contact that strikes the lock hook 12 against the bias from the spring 17, the rod type slider 11 mounting the lock hook 12 slides rightward in the width direction of the printer 100 by the bias from the spring 17. Accordingly, the bent portion 125 of the lock hook 12, which bends rightward in FIG. 7 from the tip of the lock hook 12, enters a recess 136 of the hook receiver 13. Thus, the lock hook 12 is caught by the hook receiver 13 in the close state depicted in FIG. 6.

The right wall 18*a* and the left wall 18*b* mount cover open biasing members 19*a* and 19*b*, respectively, which bias the front cover 50 frontward, that is, downward in FIG. 6, in the close state. Each of the cover open biasing members 19*a* and 19*b*, which generates a bias, includes a torsion coil spring, a compression coil spring, a flat spring, or the like, for example, but is not limited to those.

The bias from the cover open biasing members 19*a* and 19*b* presses the front cover 50 mounted with the lock hooks 12 frontward, that is, downward in FIG. 7. As the hook side contact face 124 of the lock hook 12 strikes the receiver side contact face 133 of the recess 136 of the hook receiver 13, frontward movement of the front cover 50 is restricted and the front cover 50 is secured at the close state.

As the two lock hooks 12 (e.g., the right lock hook 12*a*C and the left lock hook 12*b*) are caught by the two hook receivers 13 (e.g., the right hook receiver 13*a*C and the left hook receiver 13*b*), respectively, movement of the front cover 50 in a direction in which the front cover 50 opens, that is, a downward direction in FIG. 6 and the direction B1 in FIG. 3, is restricted. Thus, the front cover 50 is retained at the close state.

As illustrated in FIG. 5, the front cover release button 15 is disposed on an exterior face of the right wall 18*a*. When the user presses the front cover release button 15 in the close state depicted in FIG. 6, the front cover release button 15 presses and slides the rod type slider 11 leftward in the width direction of the printer 100.

Accordingly, the hook side contact face 124 of the lock hook 12 depicted in FIG. 7 moves leftward beyond a left end of the receiver side contact face 133 of the recess 136 of the hook receiver 13. This movement eliminates striking of the hook side contact face 124 on the receiver side contact face 133 against the bias from the cover open biasing members 19*a* and 19*b*. The bias from the cover open biasing members 19*a* and 19*b* moves the front cover 50 frontward, thus moving the bent portion 125 of the lock hook 12, which is movable into the recess 136, to a frontward position disposed frontward from the recess 136 in the front-rear direction of the printer 100. Accordingly, the lock hook 12 separates from the hook receiver 13, allowing the front cover 50 to move in an open direction, that is, the direction B1 in FIG. 3.

With the construction described above, when the user presses the front cover release button 15 in the close state of the front cover 50 of the printer 100, the rod type slider 11 slides leftward in the width direction of the printer 100. Accordingly, the lock hook 12 separates from the hook receiver 13, allowing the front cover 50 to pivot and open.

Conversely, when the user pivots the front cover 50 of the printer 100 in the open state in a close direction, the lock hook 12 comes into contact with the hook receiver 13. When the user presses the front cover 50 further, the lock hook 12 is guided by the hook receiver 13 and the rod type slider 11 mounting the lock hook 12 slides leftward in the width direction of the printer 100. Thereafter, when the user presses the front cover 50 until the bent portion 125 of the lock hook 12, which is movable into the recess 136, reaches an opposed position where the bent portion 125 is disposed opposite the recess 136, the rod type slider 11 slides rightward in the width direction of the printer 100. Thus, the lock hook 12 is caught by and engaged with the hook receiver 13.

With the printer 100 according to the comparative example, as the lock hook 12 engages the hook receiver 13, the front cover 50 closes. Conversely, as the lock hook 12 separates from the hook receiver 13, the front cover 50 opens.

Figure 8:
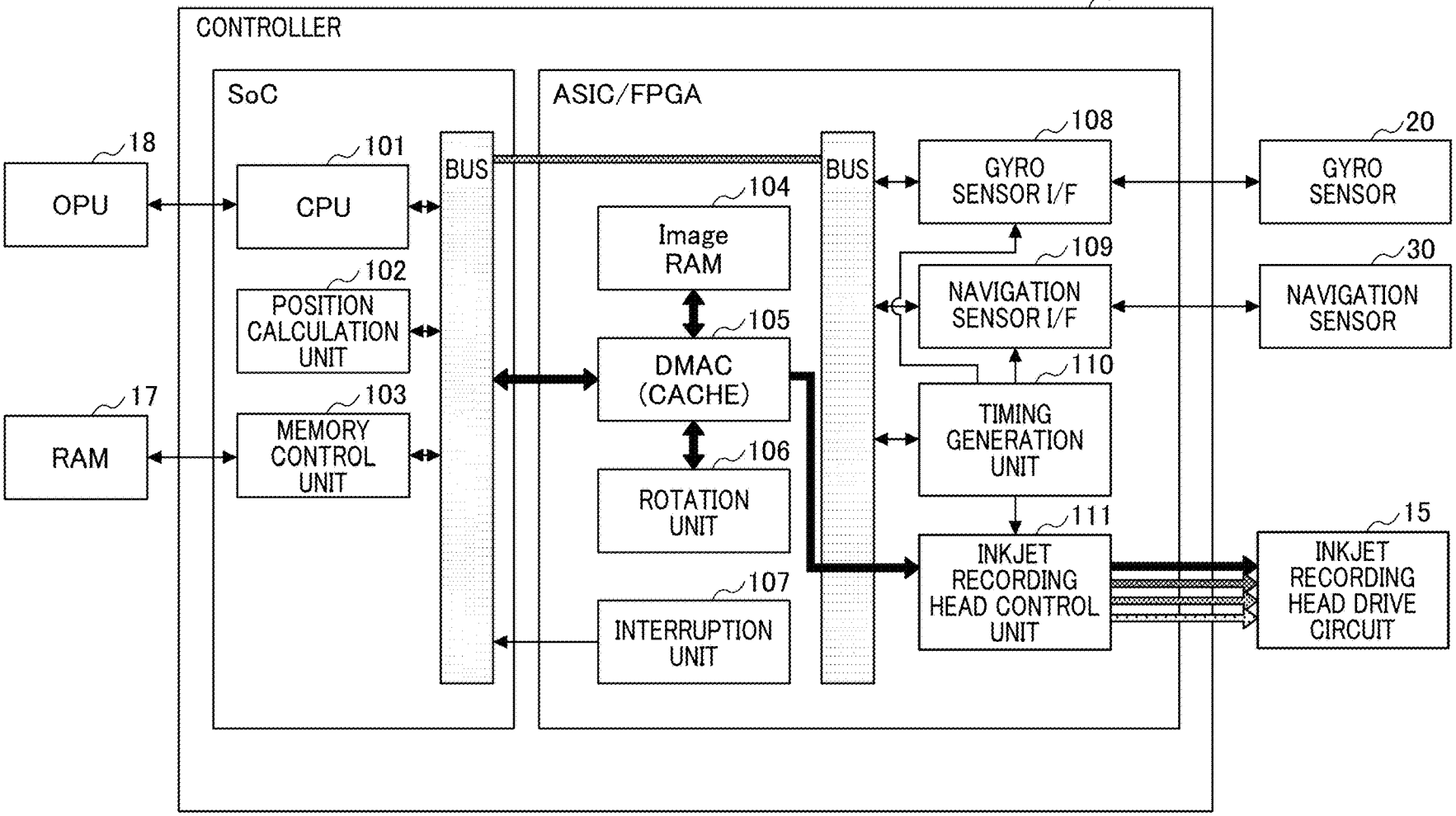
FIG. 8 (PRIOR ART)
FIG. 8 is a schematic top view of the printer depicted in FIG. 6, illustrating half closing of the front cover.

FIG. 8 is a top view of the printer 100 according to the comparative example, illustrating half closing of the front cover 50.

If the user presses the front cover 50 solely at one end of the front cover 50 in the width direction of the printer 100, for example, the front cover 50 may warp and may be closed while the upper end of the front cover 50 where the rod type slider 11 is disposed is tilted obliquely relative to the body 20. FIG. 8 illustrates the front cover 50 being closed in a state in which a left portion of the front cover 50 in the width direction of the printer 100 is closed prior to a right portion of the front cover 50.

If the front cover 50 is closed such that the left portion of the front cover 50 is closed prior to the right portion of the front cover 50, the left lock hook 12*b* among the right lock hook 12*a*C and the left lock hook 12*b* is brought into contact with and guided by the left hook receiver 13*b*, causing the rod type slider 11 to slide leftward in the width direction of the printer 100. Thereafter, when the front cover 50 is moved until the hook side guide face 123 of the left lock hook 12*b* reaches an opposed position where the hook side guide face 123 is disposed opposite the recess 136 of the left hook receiver 13*b*, the left lock hook 12*b* and the left hook receiver 13*b* have no faces that strike each other against the bias from the spring 17.

If tilting of the upper end of the front cover 50 is small enough to allow the hook side guide face 123 to be disposed opposite the receiver side guide face 132 in a right engagement assembly 16*a*C, even if the right engagement assembly 16*a*C is applied with the bias from the spring 17, the right lock hook 12*a*C comes into contact with the right hook receiver 13*a*C. Accordingly, the hook side guide face 123 is disposed opposite the recess 136 in a left engagement assembly 16*b*. Conversely, the hook side guide face 123 is not disposed opposite the recess 136 in the right engagement assembly 16*a*C, preventing the rod type slider 11 from sliding rightward in the width direction of the printer 100, that is, an engagement direction.

When the front cover 50 is closed further from an opposed state in which the hook side guide face 123 is disposed opposite the receiver side guide face 132 in the right engagement assembly 16*a*C, tilting of the upper end of the front cover 50 is eliminated, allowing the front cover 50 to be closed without half closing.

Conversely, if tilting of the upper end of the front cover 50, when the front cover 50 is closed such that the left portion of the front cover 50 is closed prior to the right portion of the front cover 50, is great enough to inhibit the hook side guide face 123 from being disposed opposite the receiver side guide face 132 in the right engagement assembly 16*a*C, disadvantages may generate as below.

For example, when the hook side guide face 123 is disposed opposite the recess 136 in the left engagement assembly 16*b*, even though the right lock hook 12*a*C and the right hook receiver 13*a*C do not attain a positional relation to engage with each other, the right lock hook 12*a*C does not come into contact with the right hook receiver 13*a*C. Accordingly, even though the hook side guide face 123 is not disposed opposite the recess 136 in the right engagement assembly 16*a*C, the rod type slider 11 slides rightward in the width direction of the printer 100, that is, the engagement direction. Consequently, the left lock hook 12*b* solely engages the left hook receiver 13*b*. The right lock hook 12*a*C drops off without engaging the right hook receiver 13*a*C as illustrated in FIG. 8. Thus, half closing of the front cover 50 occurs.

Even if the front cover 50 suffers from half closing, the left lock hook 12*b* engages the left hook receiver 13*b*, restricting movement of the front cover 50 in the open direction, that is, the downward direction in FIG. 8 and the direction B1 in FIG. 3. Thus, the front cover 50 is retained with half closing. Accordingly, it is difficult for the user to notice that the front cover 50 is closed erroneously. The user notices that the front cover 50 suffers from half closing when an error occurs as the user instructs printing after the user closes the front cover 50. Hence, the user is forced to open and close the front cover 50 again.

Additionally, the front cover 50, while suffering from half closing, is warped. The front cover 50 may be imposed with stress continuously, resulting in breakage or shortened life of the front cover 50.

A description is provided of a construction of the printer 100 according to a first embodiment.

Figure 9:
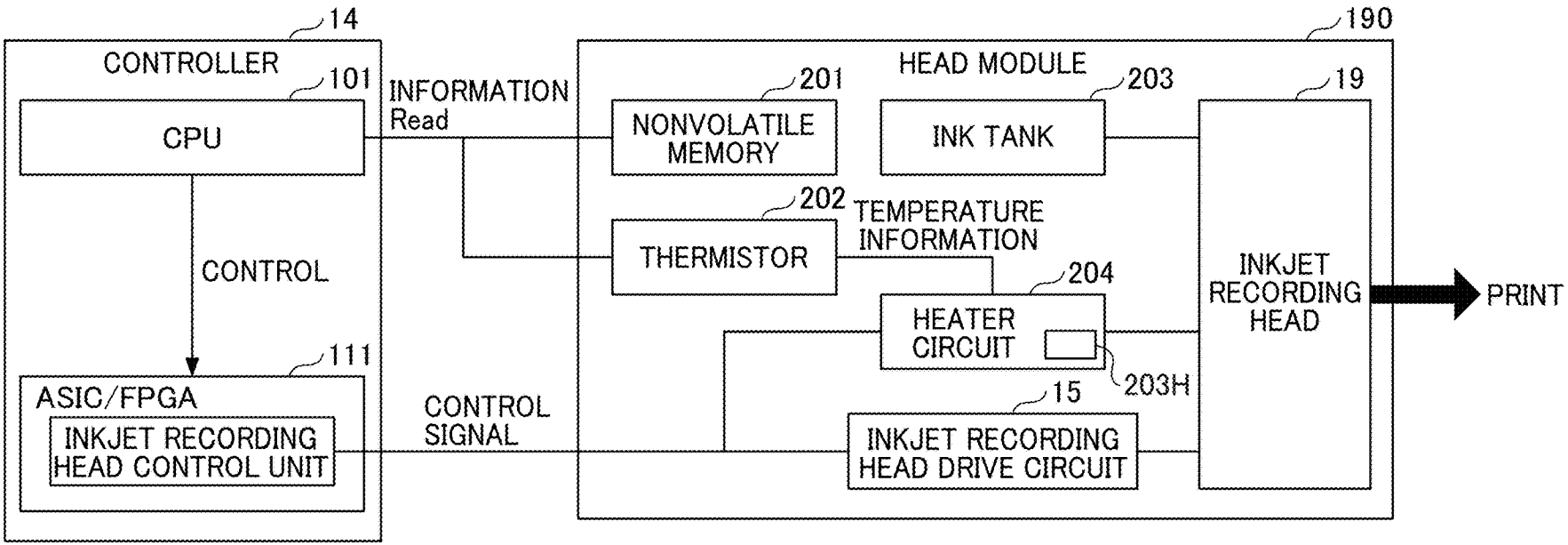
FIG. 9 is a schematic top view of the printer depicted in FIG. 1 according to a first embodiment of the present disclosure.
Figures 10, 10A:
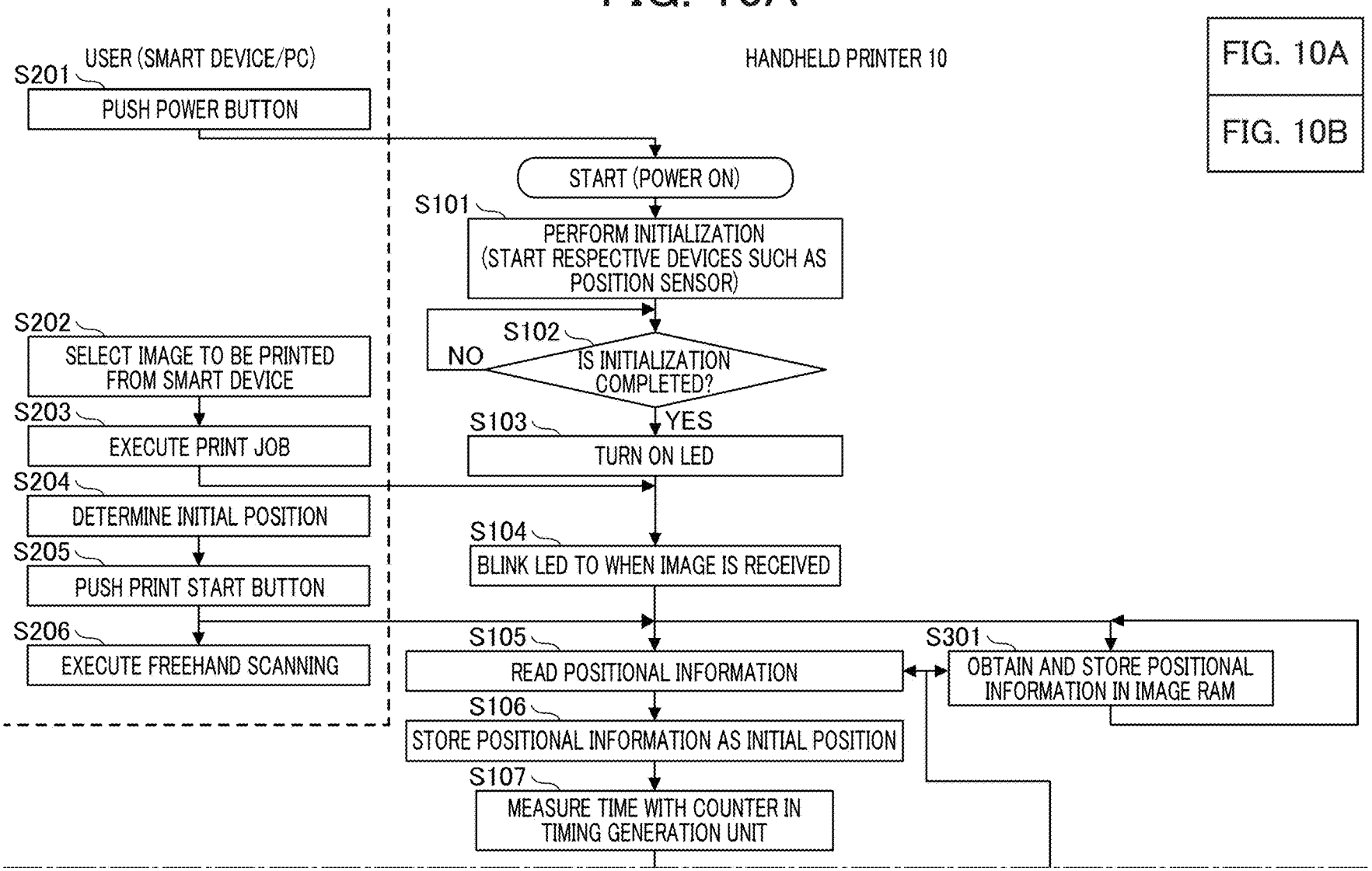
FIG. 10 is an enlarged diagram of a right engagement assembly incorporated in the printer depicted in FIG. 9.
Figure 10B:
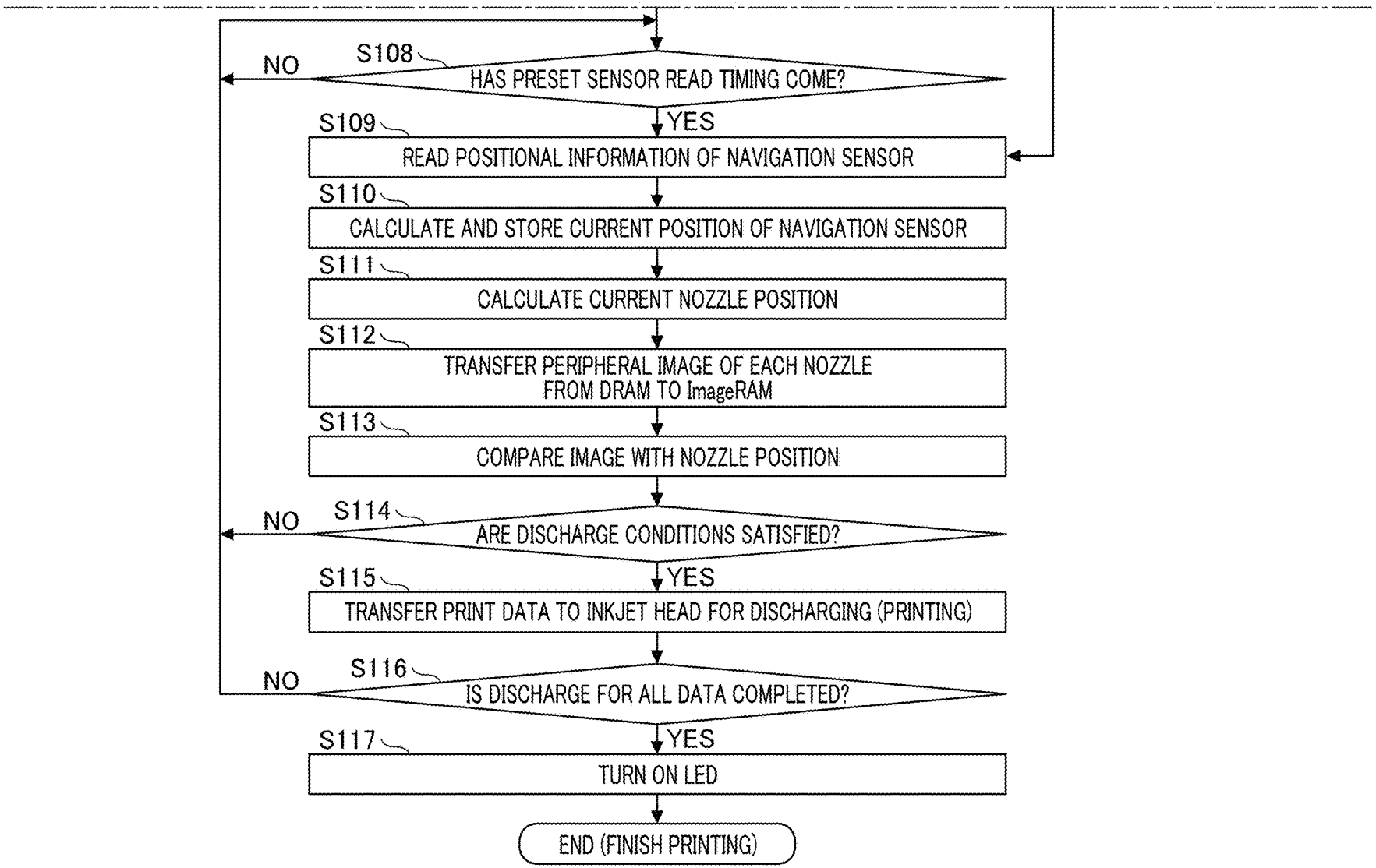

FIG. 9 is a schematic top view of the printer 100 according to the first embodiment, illustrating the front cover 50 in the close state in which the front cover 50 covers the front of the printer 100. FIG. 10 is an enlarged diagram of a right engagement assembly 16*a* of the printer 100 according to the first embodiment immediately before the close state. The right engagement assembly 16*a* includes a right lock hook 12*a* and a right hook receiver 13*a*.

The left engagement assembly 16*b* including the left lock hook 12*b* and the left hook receiver 13*b* according to the first embodiment is equivalent to the engagement assembly 16 depicted in FIG. 7 illustrating an enlarged diagram of the engagement assembly 16.

The construction of the printer 100 according to the first embodiment is equivalent to the above-described construction of the printer 100 according to the comparative example except for the length of a right receiver side guide face 132*a* of the right hook receiver 13*a*, which is lengthened. Hence, a description of a construction of the printer 100 according to the first embodiment that is common to the printer 100 according to the comparative example is omitted properly.

As illustrated in FIG. 10, in the printer 100 according to the first embodiment, a length L1 of the right receiver side guide face 132*a* of the right hook receiver 13*a* is greater than a length L2 of a right hook side guide face 123*a* of the right lock hook 12*a*. As illustrated in FIG. 9, FIG. 7 illustrating the engagement assembly 16 equivalent to the left engagement assembly 16*b*, and FIG. 10 illustrating the right engagement assembly 16*a*, the length L1 of the right receiver side guide face 132*a* depicted in FIG. 10 is greater than a length L1' depicted in FIG. 7 of the receiver side guide face 132 of the hook receiver 13 equivalent to the left hook receiver 13*b*.

As illustrated in FIG. 10, the length L1 of the right receiver side guide face 132*a* is greater than a length L3 of a bent portion 125*a* of the right lock hook 12*a*, which is movable into a right recess 136*a* of the right hook receiver 13*a*. The bent portion 125*a* of the right lock hook 12*a* bends rightward in FIG. 10 from a tip of the right lock hook 12*a*. The length L3 of the bent portion 125*a* of the right lock hook 12*a* defines a length between a right hook tip face 121*a* and a right hook side contact face 124*a*.

A width direction motion guide face 122*a*, a receiver tip face 131*a*, and a right receiver side contact face 133*a* depicted in FIG. 10 are equivalent to the width direction motion guide face 122, the receiver tip face 131, and the receiver side contact face 133 depicted in FIG. 7, respectively.

Figure 11:
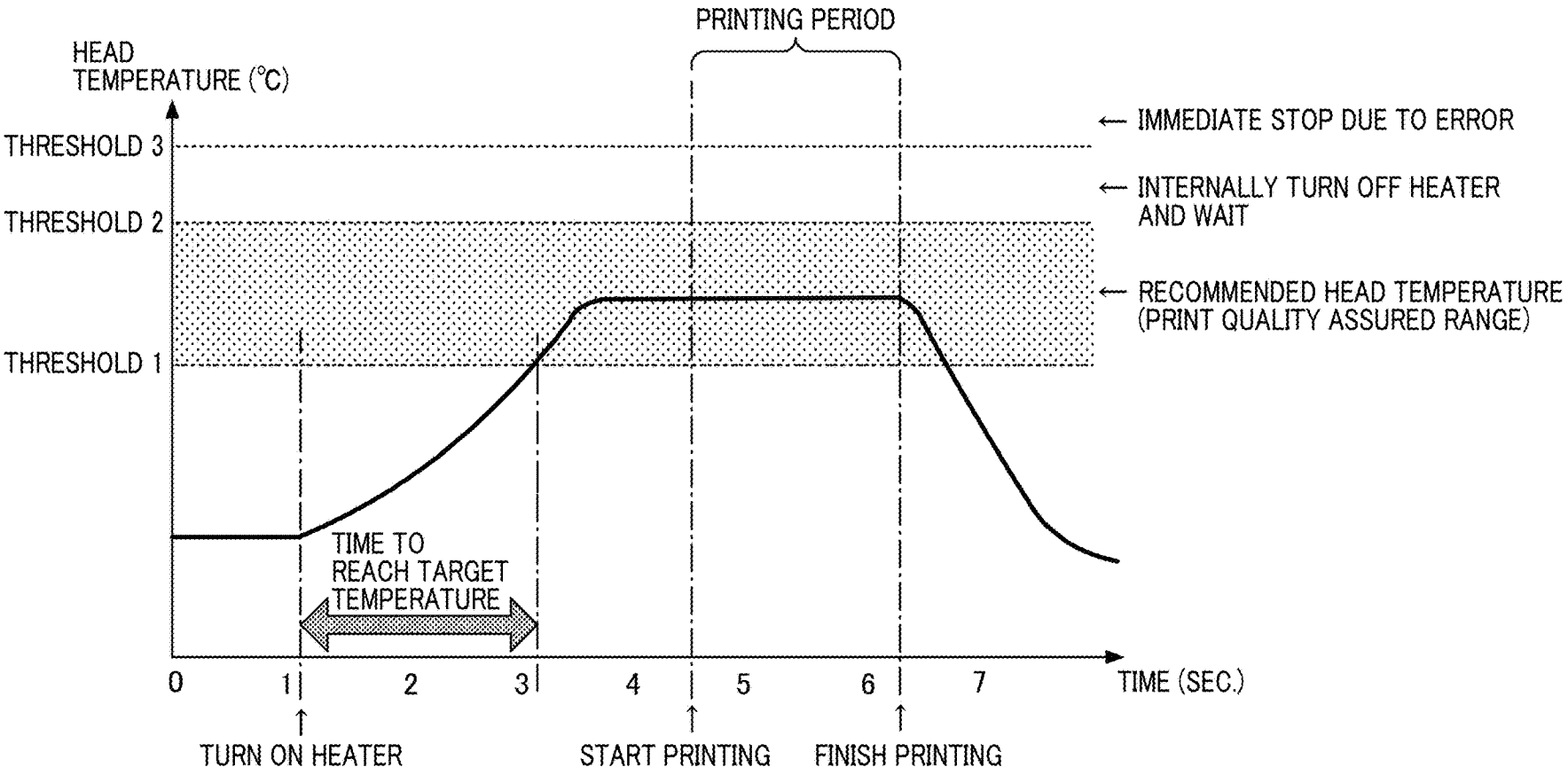
FIG. 11 is a schematic top view of the printer depicted in FIG. 9 when the user moves the front cover to close the front cover while the front cover is tilted obliquely relative to the body.

FIG. 11 is a top view of the printer 100 according to the first embodiment when the user moves the front cover 50 to close the front cover 50 while the upper end of the front cover 50 is tilted obliquely relative to the body 20.

Like in the printer 100 according to the comparative example, when the user presses the front cover 50 solely at one end of the front cover 50 in the width direction of the printer 100, the front cover 50 warps and is closed while the upper end of the front cover 50 where the rod type slider 11 is disposed is tilted obliquely relative to the body 20. FIG. 11 illustrates the front cover 50 being closed in a state in which the left portion of the front cover 50 in the width direction of the printer 100 is closed prior to the right portion of the front cover 50.

If the user moves the front cover 50 of the printer 100 according to the first embodiment to close the front cover 50 such that the left portion of the front cover 50 is closed prior to the right portion of the front cover 50 and the front cover 50 is tilted, the left lock hook 12*b* is brought into contact with and guided by the left hook receiver 13*b*, causing the rod type slider 11 to slide leftward in the width direction of the printer 100. Thereafter, when the front cover 50 is moved until the bent portion 125 of the left lock hook 12*b* reaches the opposed position where the bent portion 125 is disposed opposite the recess 136 of the left hook receiver 13*b*, the left lock hook 12*b* and the left hook receiver 13*b* have no faces that strike each other against the bias from the spring 17.

Even if tilting of the upper end of the front cover 50 is great enough to cause half closing of the front cover 50 in the printer 100 according to the comparative example described above, the right hook side guide face 123*a* of the right lock hook 12*a* of the right engagement assembly 16*a* may strike the right receiver side guide face 132*a* of the right hook receiver 13*a*. It is because, according to the first embodiment, the right receiver side guide face 132*a* of the right hook receiver 13*a* is greater than the receiver side guide face 132 of the left hook receiver 13*b*, allowing the right lock hook 12*a* to come into contact with the right hook receiver 13*a* in an increased span compared to the printer 100 according to the comparative example incorporating the two receiver side guide faces 132 that have an identical length. Hence, when the left lock hook 12*b* is slidable in the engagement direction solely in the left engagement assembly 16*b*, the right engagement assembly 16*a* of the printer 100 attains the increased span where the right engagement assembly 16*a* restricts rightward movement of the right lock hook 12*a* in the width direction of the printer 100, that is, the engagement direction, compared to the printer 100 according to the comparative example.

Accordingly, even if the hook side guide face 123 of the left engagement assembly 16*b* is disposed opposite the recess 136 when tilting of the upper end of the front cover 50 is great enough to cause half closing of the front cover 50 in the printer 100 according to the comparative example, the printer 100 according to the first embodiment may prevent the rod type slider 11 from sliding rightward in the width direction of the printer 100, that is, the engagement direction. Consequently, the printer 100 according to the first embodiment prevents the left lock hook 12*b* from engaging the left hook receiver 13*b* while the right lock hook 12*a* does not engage the right hook receiver 13*a*, preventing half closing of the front cover 50.

When the user closes the front cover 50 further from the opposed state in which the right hook side guide face 123*a* is disposed opposite the right receiver side guide face 132*a* in the right engagement assembly 16*a*, tilting of the upper end of the front cover 50 is eliminated, allowing the front cover 50 to be closed without half closing.

As described above, the right receiver side guide face 132*a* of the printer 100 according to the first embodiment is greater than the receiver side guide face 132 of the printer 100 according to the comparative example, attaining the increased span to prevent half closing of the front cover 50 upon tilting of the upper end of the front cover 50.

The length L1 of the right receiver side guide face 132*a* is preferably defined as below. For example, in a state in which the front cover 50 warps in a substantial amount, e.g., an upper limit amount, that generates as the user presses the front cover 50 with a regular force, when the hook side guide face 123 of the left engagement assembly 16*b* is disposed opposite the recess 136, the length L1 of the right receiver side guide face 132*a* preferably allows the right receiver side guide face 132*a* to be disposed opposite the right hook side guide face 123*a*.

Figure 12:
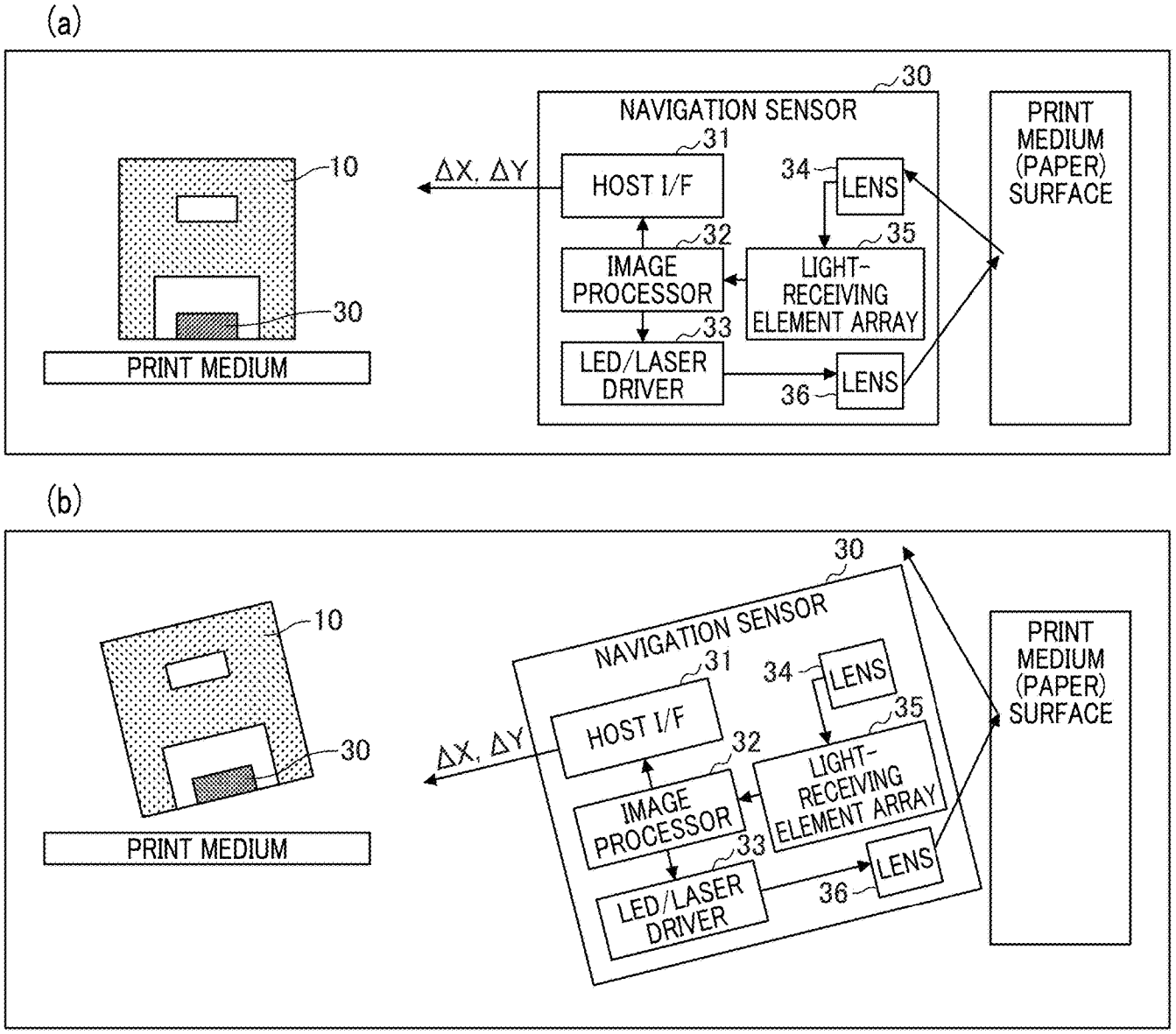
FIG. 12 is a top view of a rod type slider, lock hooks, and hook receivers of the printer depicted in FIG. 8 while the lock hooks engage the hook receivers, respectively.

FIG. 12 is a top view of the rod type slider 11, the right lock hook 12*a*C, the right hook receiver 13*a*C, the left lock hook 12*b*, and the left hook receiver 13*b* of the printer 100 according to the comparative example described above while the right lock hook 12*a*C and the left lock hook 12*b* engage the right hook receiver 13*a*C and the left hook receiver 13*b*, respectively.

Figure 13A:
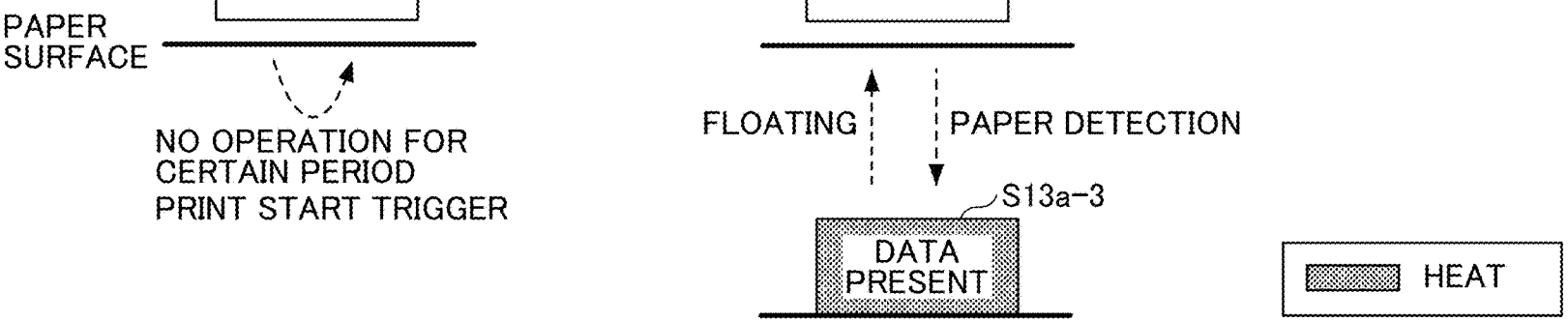
FIG. 13 is a top view of the rod type slider, the lock hooks, and the hook receivers of the printer depicted in FIG. 12 while the front cover suffers from half closing.
Figure 13B:
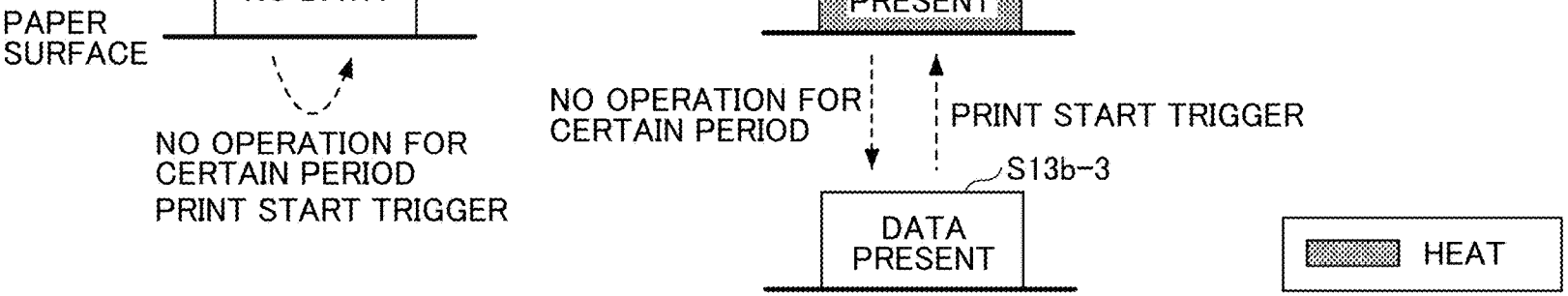

FIG. 13 is a top view of the rod type slider 11, the right lock hook 12*a*C, the right hook receiver 13*a*C, the left lock hook 12*b*, and the left hook receiver 13*b* of the printer 100 according to the comparative example while the front cover 50 suffers from half closing.

Figure 14:
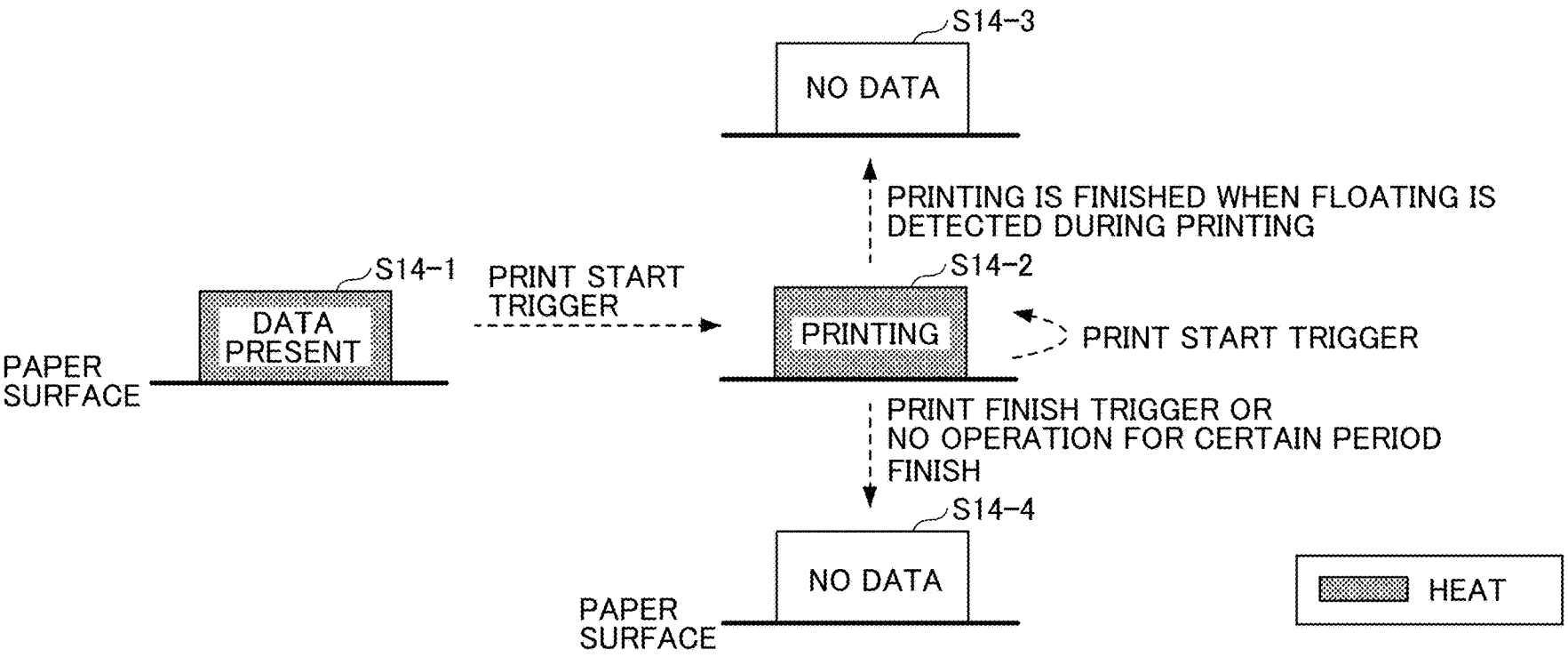
FIG. 14 is a top view of the rod type slider, the lock hooks, and the hook receivers of the printer depicted in FIG. 9 when the user moves the front cover to close the front cover while the front cover is tilted obliquely relative to the body.

FIG. 14 is a top view of the rod type slider 11, the right lock hook 12*a*, the right hook receiver 13*a*, the left lock hook 12*b*, and the left hook receiver 13*b* of the printer 100 according to the first embodiment when the user moves the front cover 50 to close the front cover 50 while the upper end of the front cover 50 is tilted obliquely relative to the body 20.

Figures 15, 15A:
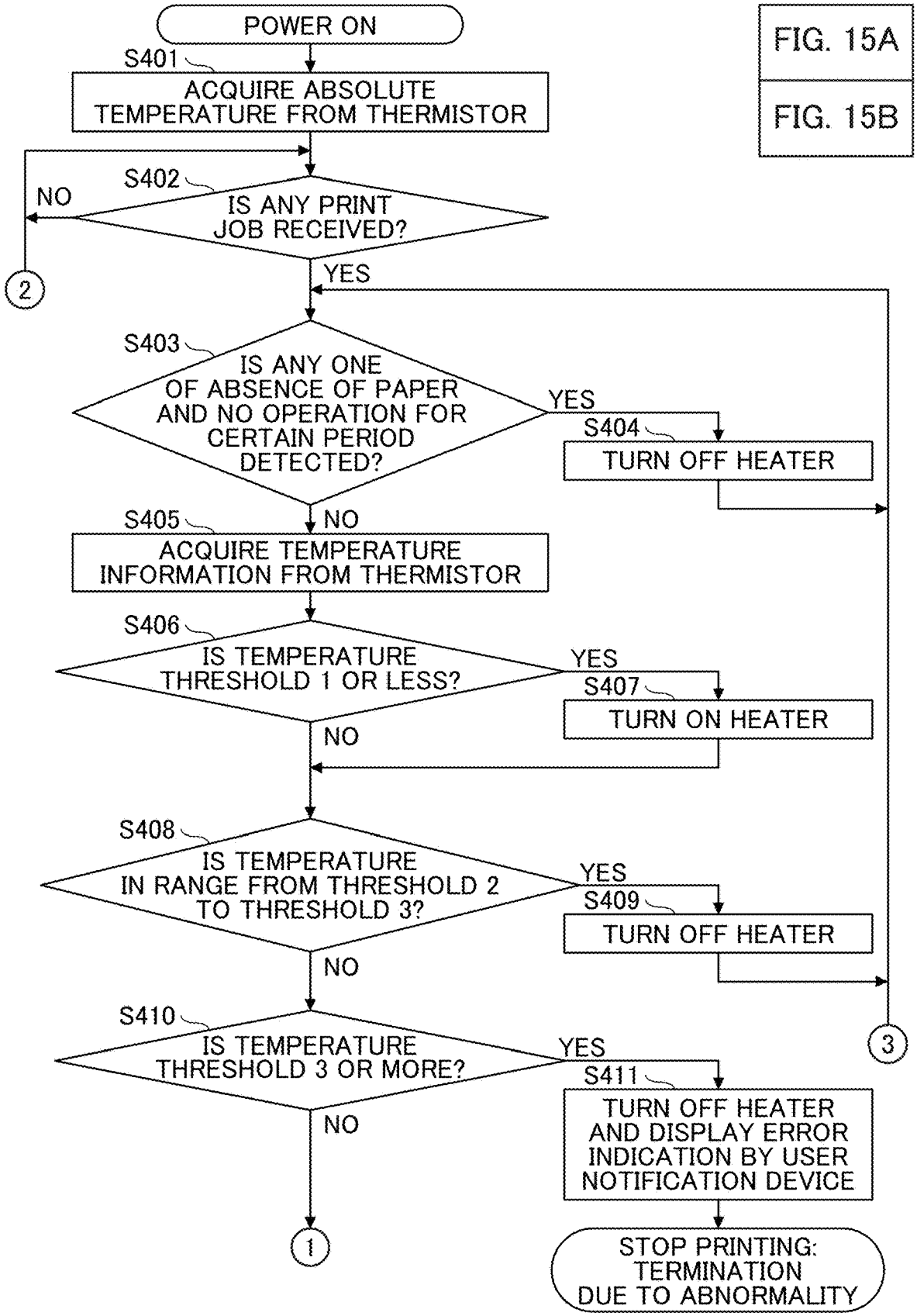
FIG. 15A is a perspective view of a right hook receiver of the printer depicted in FIG. 13.
Figure 15B:
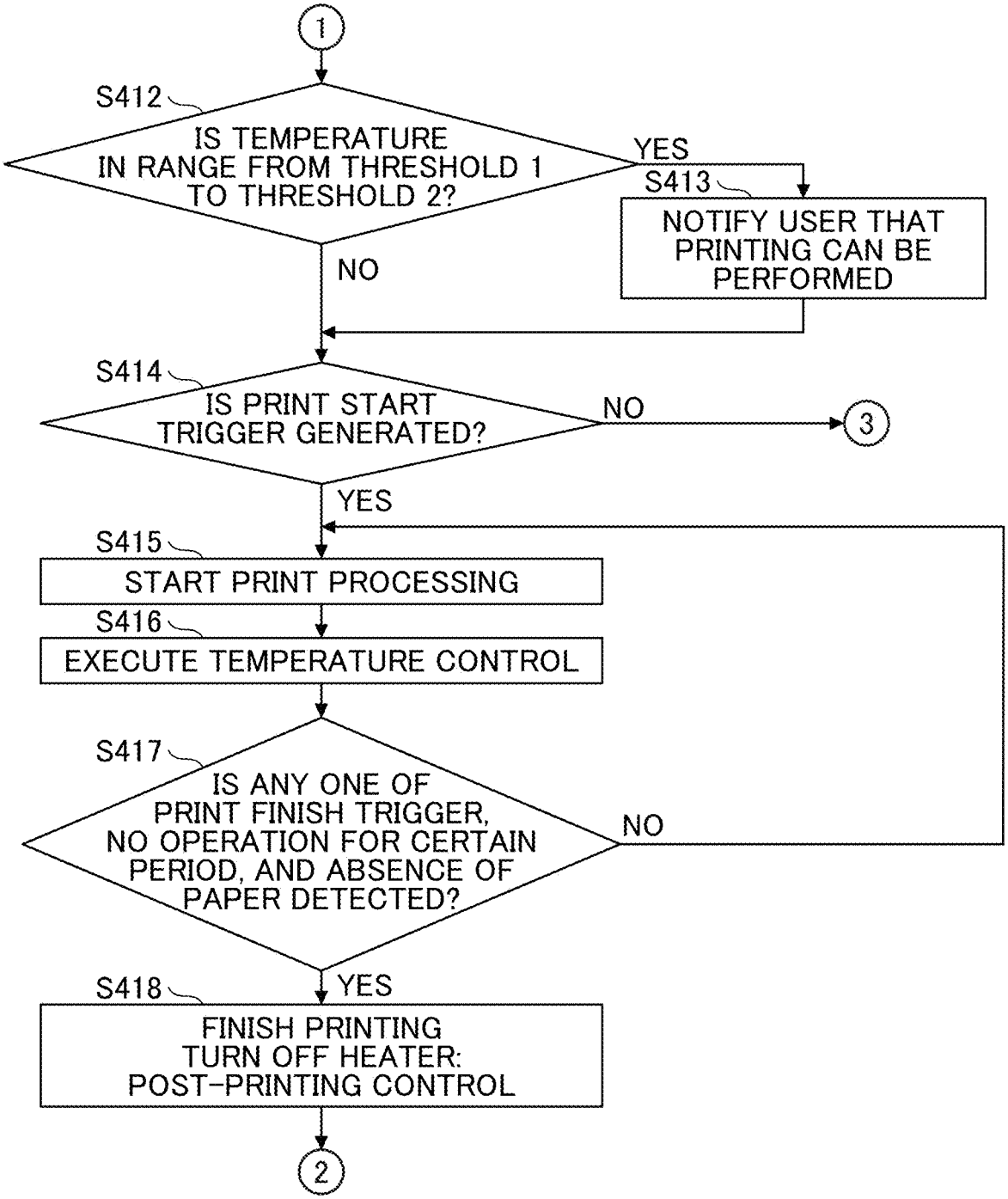
FIG. 15B is a perspective view of the right hook receiver of the printer depicted in FIG. 14 for comparison in shape with the right hook receiver depicted in FIG. 15A.

FIGS. 15A and 15B are diagrams for comparing the shape of the right hook receiver 13*a*C of the printer 100 according to the comparative example with the shape of the right hook receiver 13*a* of the printer 100 according to the first embodiment. FIG. 15A is a perspective view of the right hook receiver 13*a*C of the printer 100 according to the comparative example. FIG. 15B is a perspective view of the right hook receiver 13*a* of the printer 100 according to the first embodiment.

As illustrated in FIG. 13, in the printer 100 according to the comparative example, when the user moves the front cover 50 to close the front cover 50 while the front cover 50 is tilted, that is, while the rod type slider 11 is tilted, the left lock hook 12*b* engages the left hook receiver 13*b*; however, the right lock hook 12*a*C surmounts a tip of the right hook receiver 13*a*C. Accordingly, the right lock hook 12*a*C drops off from the right hook receiver 13*a*C, resulting in half closing of the front cover 50 in which one of the two lock hooks, that is, the left lock hook 12*b*, is locked.

As illustrated in FIGS. 15A and 15B, a tip of the right hook receiver 13*a* mounted on the body 20 of the printer 100 according to the first embodiment is extended compared to the tip of the right hook receiver 13*a*C of the printer 100 according to the comparative example. For example, the right hook receiver 13*a* of the printer 100 according to the first embodiment is greater than the right hook receiver 13*a*C of the printer 100 according to the comparative example by a length D1 of 6 mm. A radius R of a right receiver tip corner 140*a* of the right hook receiver 13*a* is 2 mm although a radius R of a right receiver tip corner 140*a*C of the right hook receiver 13*a*C is 4 mm. Thus, a length of the right receiver side guide face 132*a* of the printer 100 according to the first embodiment is greater than a length of a right receiver side guide face 132*a*C of the printer 100 according to the comparative example by 8 mm.

An extension of the right receiver side guide face 132*a* serves as a restraint or a stopper that restricts rightward movement of the right lock hook 12*a* while the tip of the right lock hook 12*a* is not disposed opposite the right recess 136*a* of the right hook receiver 13*a*.

Accordingly, as illustrated in FIG. 14, in the printer 100 according to the first embodiment, when the rod type slider 11 is tilted, even if a tip of the left lock hook 12*b* is disposed opposite the recess 136 of the left hook receiver 13*b*, the extension at the tip of the right hook receiver 13*a* restricts rightward movement of the right lock hook 12*a*. Consequently, the printer 100 restricts rightward sliding of the rod type slider 11 so that the right lock hook 12*a*C and the left lock hook 12*b* do not engage the right hook receiver 13*a*C and the left hook receiver 13*b*, respectively, preventing half closing of the front cover 50.

A description is provided of a construction of the printer 100 according to a second embodiment.

Figure 16:
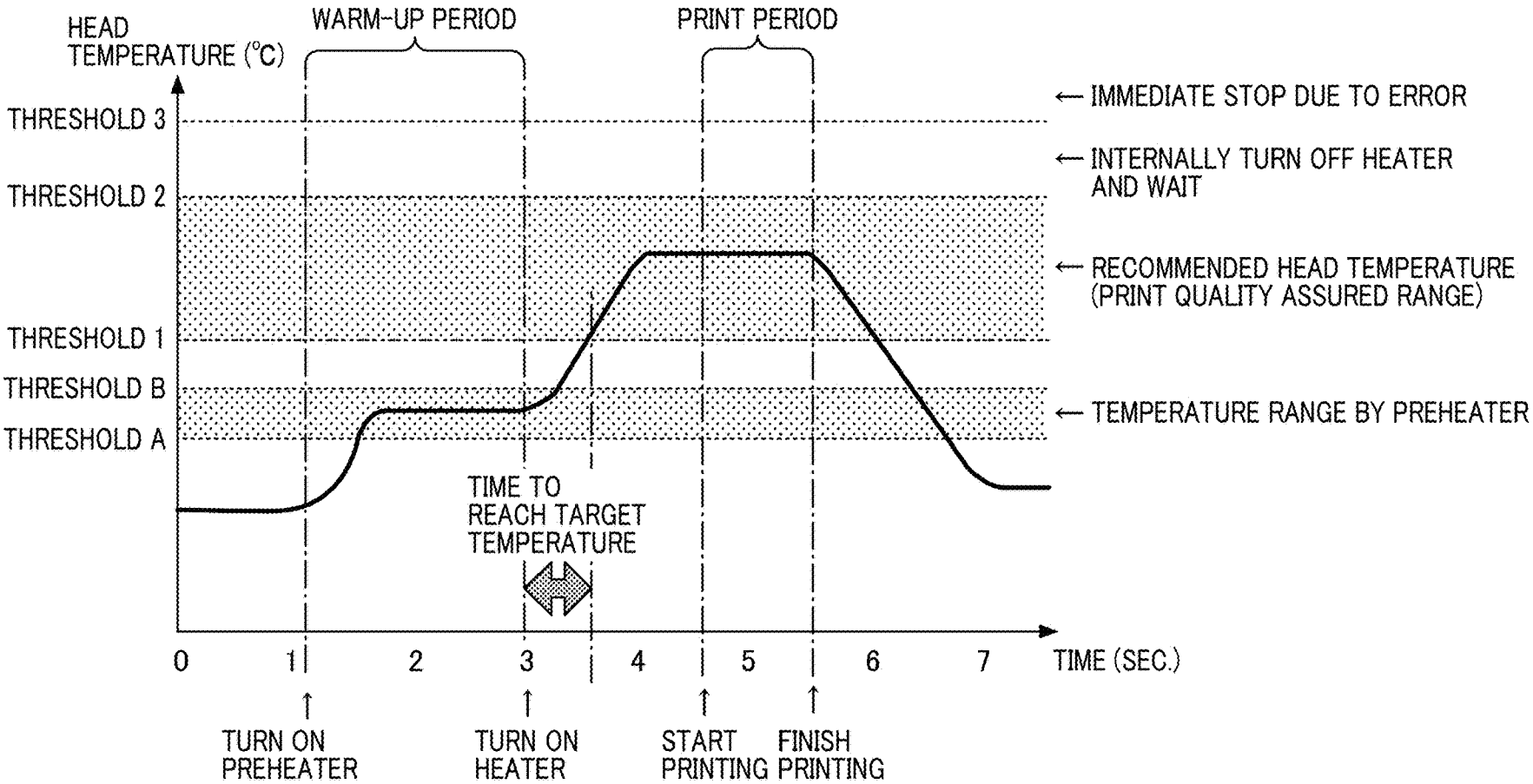
FIG. 16 is a schematic top view of the printer depicted in FIG. 1 according to a second embodiment of the present disclosure.

FIG. 16 is a schematic top view of the printer 100 according to the second embodiment, illustrating the front cover 50 in the close state in which the front cover 50 covers the front of the printer 100.

Figure 17A:
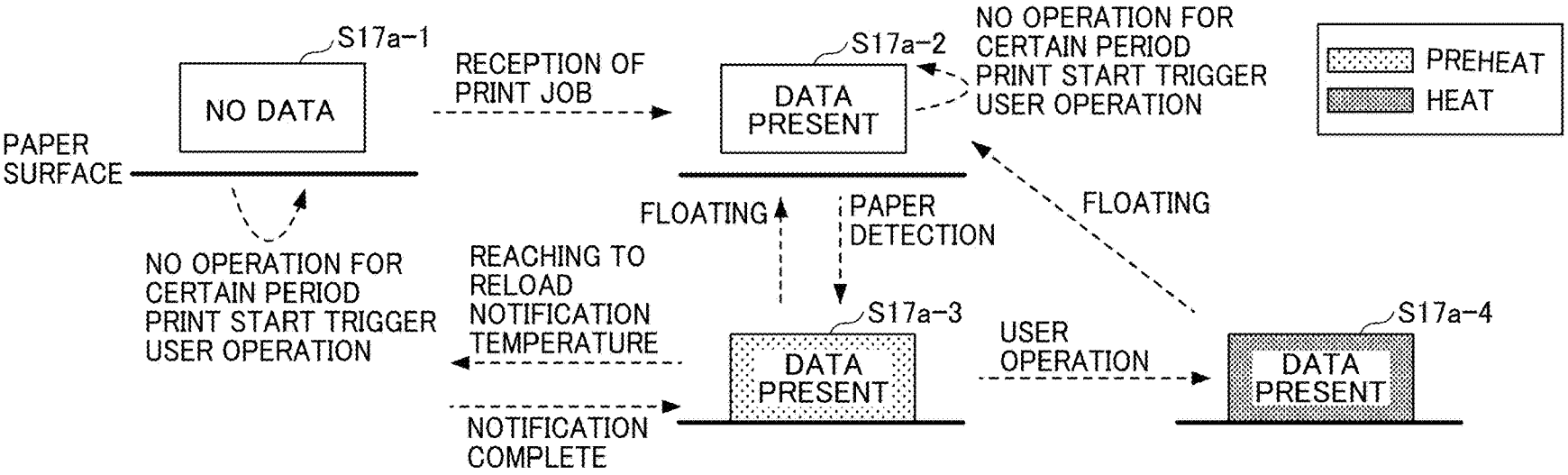
FIG. 17 is an enlarged diagram of the right engagement assembly incorporated in the printer depicted in FIG. 16.
Figure 17B:
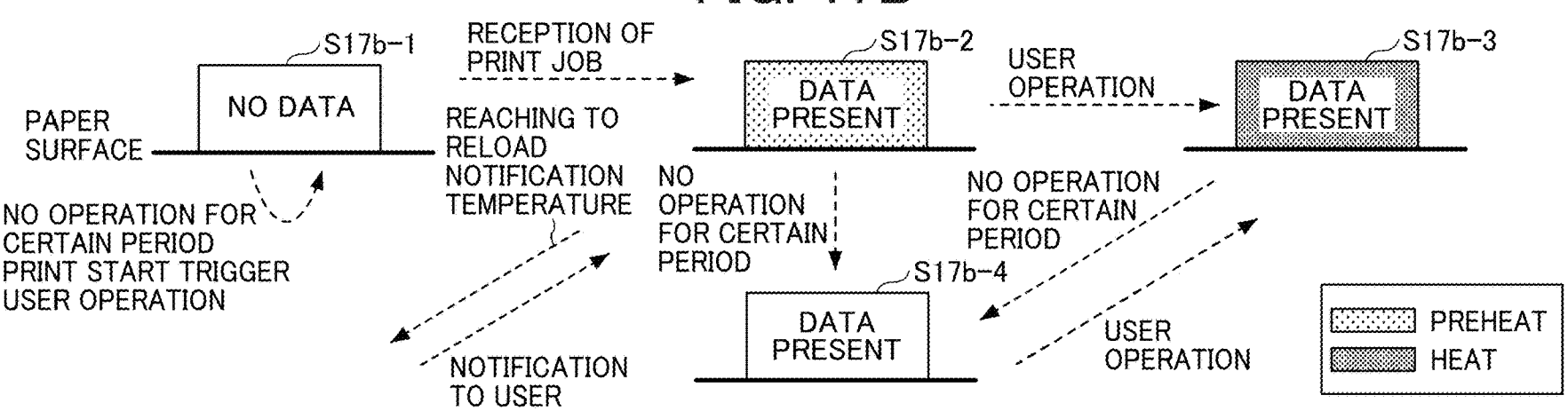

FIG. 17 is an enlarged diagram of a right engagement assembly 16*a*S of the printer 100 according to the second embodiment immediately before the close state. The right engagement assembly 16*a*S includes a right lock hook 12*a*S and a right hook receiver 13*a*S.

Like in the first embodiment, the left engagement assembly 16*b* including the left lock hook 12*b* and the left hook receiver 13*b* according to the second embodiment is equivalent to the engagement assembly 16 depicted in FIG. 7 illustrating an enlarged diagram of the engagement assembly 16.

The construction of the printer 100 according to the second embodiment is equivalent to the above-described construction of the printer 100 according to the comparative example except that the length of a right hook side guide face 123*a*S of the right lock hook 12*a*S is increased and that the length of a right recess 136*a*S of the right hook receiver 13*a*S is increased in the front-rear direction of the printer 100. Hence, a description of a construction that is common to the printer 100 according to the second embodiment and the printer 100 according to the comparative example is omitted properly.

As illustrated in FIG. 17, in the printer 100 according to the second embodiment, a length L2 of the right hook side guide face 123*a*S of the right lock hook 12*a*S is greater than a length L1 of a right receiver side guide face 132*a*S of the right hook receiver 13*a*S.

As illustrated in FIG. 16, FIG. 17 illustrating the right engagement assembly 16*a*S, and FIG. 7 illustrating the engagement assembly 16 representing the left engagement assembly 16*b*, the length L2 of the right hook side guide face 123*a*S depicted in FIG. 17 is greater than a length L2' depicted in FIG. 7 of the hook side guide face 123 of the lock hook 12 equivalent to the left lock hook 12*b*.

As illustrated in FIG. 17, the length L2 of the right hook side guide face 123*a*S is greater than a length L3' depicted in FIG. 7 of the bent portion 125 of the lock hook 12 representing the left lock hook 12*b*, which is movable into the recess 136 of the hook receiver 13 representing the left hook receiver 13*b*.

The bent portion 125 of the left lock hook 12*b*, which is movable into the recess 136, bends rightward in FIG. 7 from the tip of the left lock hook 12*b*. The length L3' of the bent portion 125 of the left lock hook 12*b* defines a length between a hook tip face 121 and the hook side contact face 124 of the left lock hook 12*b*.

Figure 18:
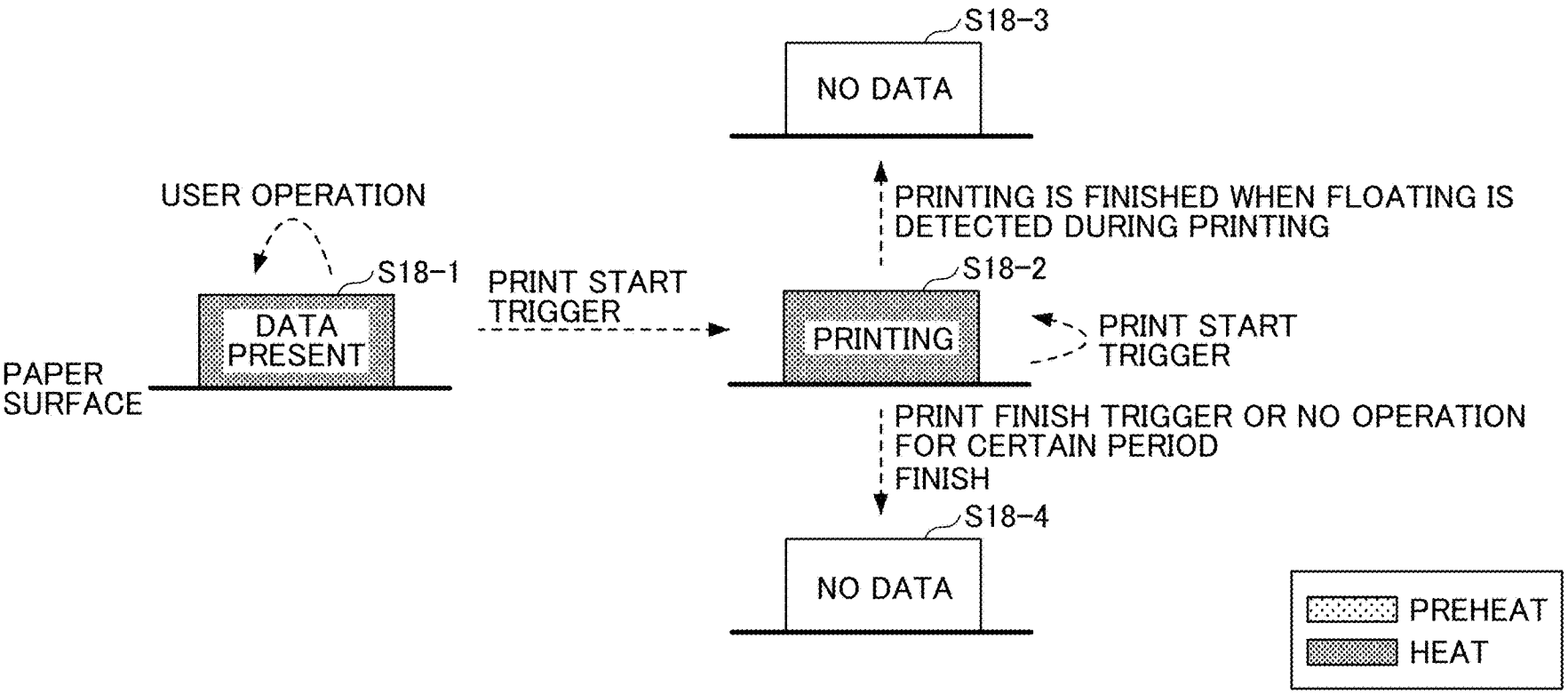
FIG. 18 is a schematic top view of the printer depicted in FIG. 16 when the user moves the front cover to close the front cover while the front cover is tilted obliquely relative to the body.

FIG. 18 is a top view of the printer 100 according to the second embodiment when the user moves the front cover 50 to close the front cover 50 while the upper end of the front cover 50 is tilted obliquely relative to the body 20.

Like in the printer 100 according to the comparative example, when the user presses the front cover 50 solely at one end of the front cover 50 in the width direction of the printer 100, the front cover 50 warps and is closed while the upper end of the front cover 50 where the rod type slider 11 is disposed is tilted obliquely relative to the body 20. FIG. 18 illustrates the front cover 50 being closed in a state in which the left portion of the front cover 50 in the width direction of the printer 100 is closed prior to the right portion of the front cover 50.

If the user moves the front cover 50 to close the front cover 50 of the printer 100 according to the second embodiment such that the front cover 50 is tilted, the left lock hook 12*b* is brought into contact with and guided by the left hook receiver 13*b*, causing the rod type slider 11 to slide leftward in the width direction of the printer 100. Thereafter, when the front cover 50 is moved until the bent portion 125 of the left lock hook 12*b*, which is movable into the recess 136, reaches the opposed position where the bent portion 125 is disposed opposite the recess 136 of the left hook receiver 13*b*, the left lock hook 12*b* and the left hook receiver 13*b* have no faces that strike each other against the bias from the spring 17.

As illustrated in FIGS. 17 and 18, in the right engagement assembly 16*a*S, the right hook side guide face 123*a*S of the right lock hook 12*a*S comes into contact with the right receiver side guide face 132*a*S of the right hook receiver 13*a*S, restricting rightward movement of the right lock hook 12*a*S in the width direction of the printer 100. Accordingly, even if the spring 17 biases the rod type slider 11 in a direction C1 in FIG. 18, the right engagement assembly 16*a*S prevents the rod type slider 11 from sliding rightward in the width direction of the printer 100.

Consequently, as illustrated in FIGS. 17 and 18, even when the bent portion 125 of the left lock hook 12*b*, which is movable into the recess 136, is disposed opposite the recess 136 of the left hook receiver 13*b*, the right engagement assembly 16*a*S prevents the bent portion 125 of the left lock hook 12*b* from entering the recess 136 of the left hook receiver 13*b*. Hence, the right engagement assembly 16*a*S prevents the left lock hook 12*b* from engaging the left hook receiver 13*b* while the right lock hook 12*a*S does not engage the right hook receiver 13*a*S, preventing half closing of the front cover 50.

With the printer 100 according to the comparative example and the embodiments, when the user moves the front cover 50 to close the front cover 50, the front cover 50 is subject to tilt such that the left portion of the front cover 50 is disposed with respect to the body 20 at a rear position that is rearward relative to the right portion of the front cover 50, causing half closing of the front cover 50 such that the left engagement assembly 16*b* solely attains proper engagement.

To address this circumstance, the printer 100 according to the first embodiment and the second embodiment has a configuration in which a slide restriction face (e.g., the right receiver side guide faces 132*a* and 132*a*S or the right hook side guide faces 123*a* and 123*a*S) of the right engagement assemblies 16*a* and 16*a*S is greater than a slide restriction face (e.g., the receiver side guide face 132 or the hook side guide face 123) of the left engagement assembly 16*b* in an open-close direction of the front cover 50. The slide restriction face of the printer 100 according to the first embodiment and the second embodiment is greater than that of the printer 100 according to the comparative example described above in the right engagement assemblies 16*a* and 16*a*S and not in the left engagement assembly 16*b*.

With the printer 100 according to the comparative example and the embodiments, when the user moves the front cover 50 to close the front cover 50, the front cover 50 barely tilts such that the right portion of the front cover 50 is disposed with respect to the body 20 at a rear position that is rearward relative to the left portion of the front cover 50, barely causing half closing of the front cover 50 such that the right engagement assembly 16*a*C attains proper engagement while the left engagement assembly 16*b* does not. Hence, it is less needed to lengthen the slide restriction face of the left engagement assembly 16*b*.

The right receiver side guide face 132*a* of the right hook receiver 13*a* of the printer 100 according to the first embodiment is greater than the receiver side guide face 132 of the right hook receiver 13*a*C of the printer 100 according to the comparative example. However, the receiver side guide face 132 of the left hook receiver 13*b* is not lengthened in view of tendency for tilting of the front cover 50 when the user closes the front cover 50. Accordingly, the length of the left hook receiver 13*b* of the left engagement assembly 16*b* of which slide restriction face is less needed to lengthen is suppressed in the front-rear direction of the printer 100, suppressing upsizing of parts and manufacturing costs of the left engagement assembly 16*b*.

Additionally, when the front cover 50 is opened, the printer 100 prevents the left hook receiver 13*b* from projecting frontward from the body 20 and obstructing operation of the user. Accordingly, since the slide restriction face of the left hook receiver 13*b* is not lengthened unnecessarily, the left hook receiver 13*b* does not degrade operation of the user.

The right hook side guide face 123*a*S of the right lock hook 12*a*S of the printer 100 according to the second embodiment is lengthened compared to the hook side guide face 123 of the right lock hook 12*a*C of the printer 100 according to the comparative example. For example, the right hook side guide face 123*a*S that is lengthened is employed in the right lock hook 12*a*S, not in the left lock hook 12*b*, in view of tendency for tilting of the front cover 50 when the user closes the front cover 50. Accordingly, the left lock hook 12*b* of the left engagement assembly 16*b* of which slide restriction face is less needed to lengthen attains a suppressed projection amount with which the left lock hook 12*b* projects toward a back face of the front cover 50, thus suppressing upsizing of parts and reducing manufacturing costs.

Additionally, when the front cover 50 is opened, the printer 100 prevents the left lock hook 12*b* from projecting toward the back face of the front cover 50 and obstructing operation of the user. Accordingly, since the slide restriction face of the left lock hook 12*b* is not lengthened unnecessarily, the left lock hook 12*b* does not degrade operation of the user.

In the printer 100 according to the second embodiment, the right hook side guide face 123*a*S of the right lock hook 12*a*S serving as an engagement mounted on the front cover 50 is lengthened. The right receiver side guide face 132*a*S serving as a guide face disposed in the right hook receiver 13*a*S is not lengthened to prevent formation of a projection in front of the right hook receiver 13*a*S. Accordingly, when an operator such as the user and a service engineer replaces the photoconductor unit 40 with new one or removes a jammed sheet, the right hook receiver 13*a*S does not obstruct operation of the operator, facilitating operation of the operator.

A description is provided of a reason why the front cover 50 of the printer 100 according to the comparative example and the embodiments is subject to tilt such that the left portion of the front cover 50 is disposed at the rear position with respect to the body 20.

Figures 19, 19A:
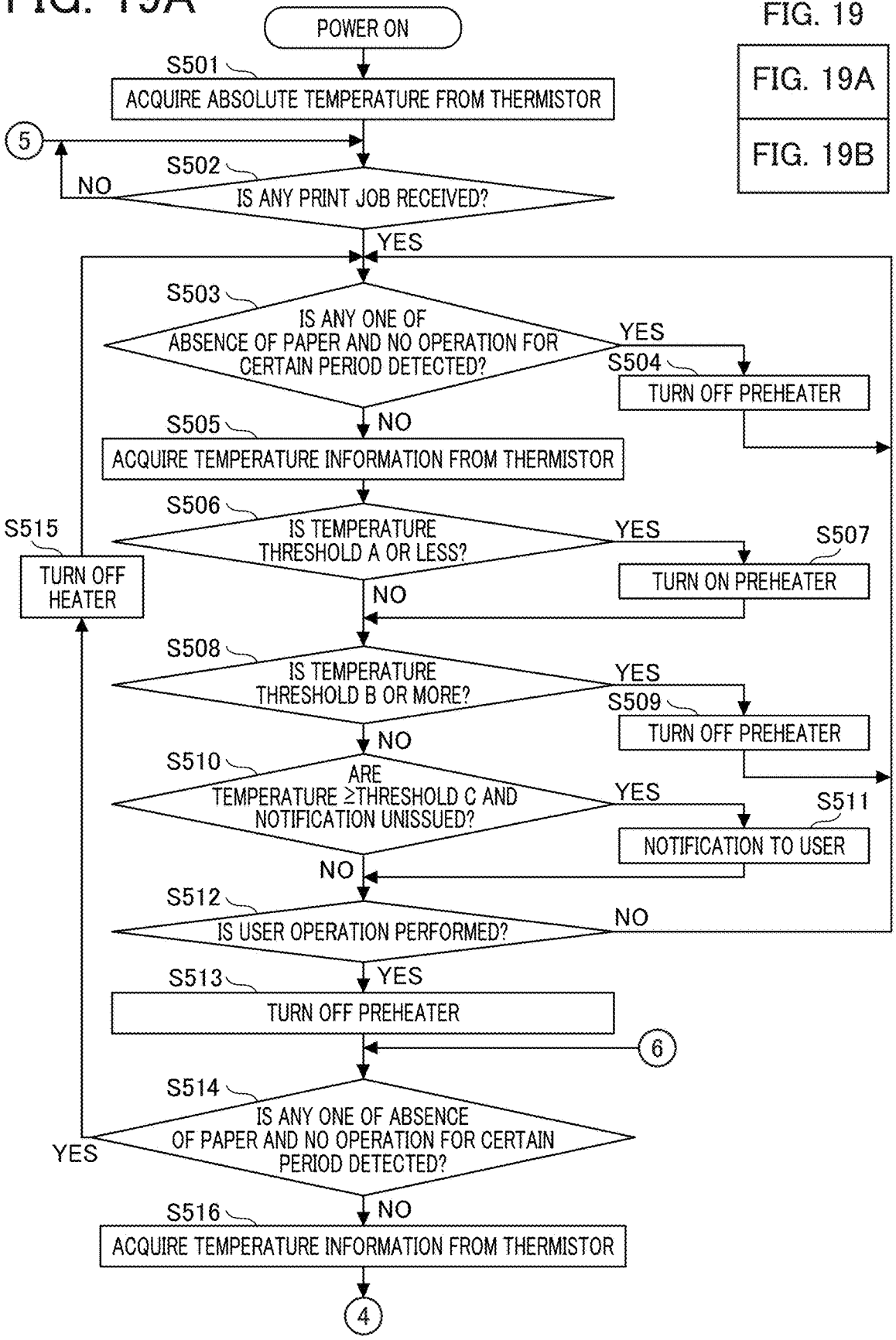
FIG. 19 is an enlarged perspective view of the printer depicted in FIG. 1, illustrating the vicinity of the front opening in the removal state in which the front cover and the photoconductor unit are removed.
Figure 19B:
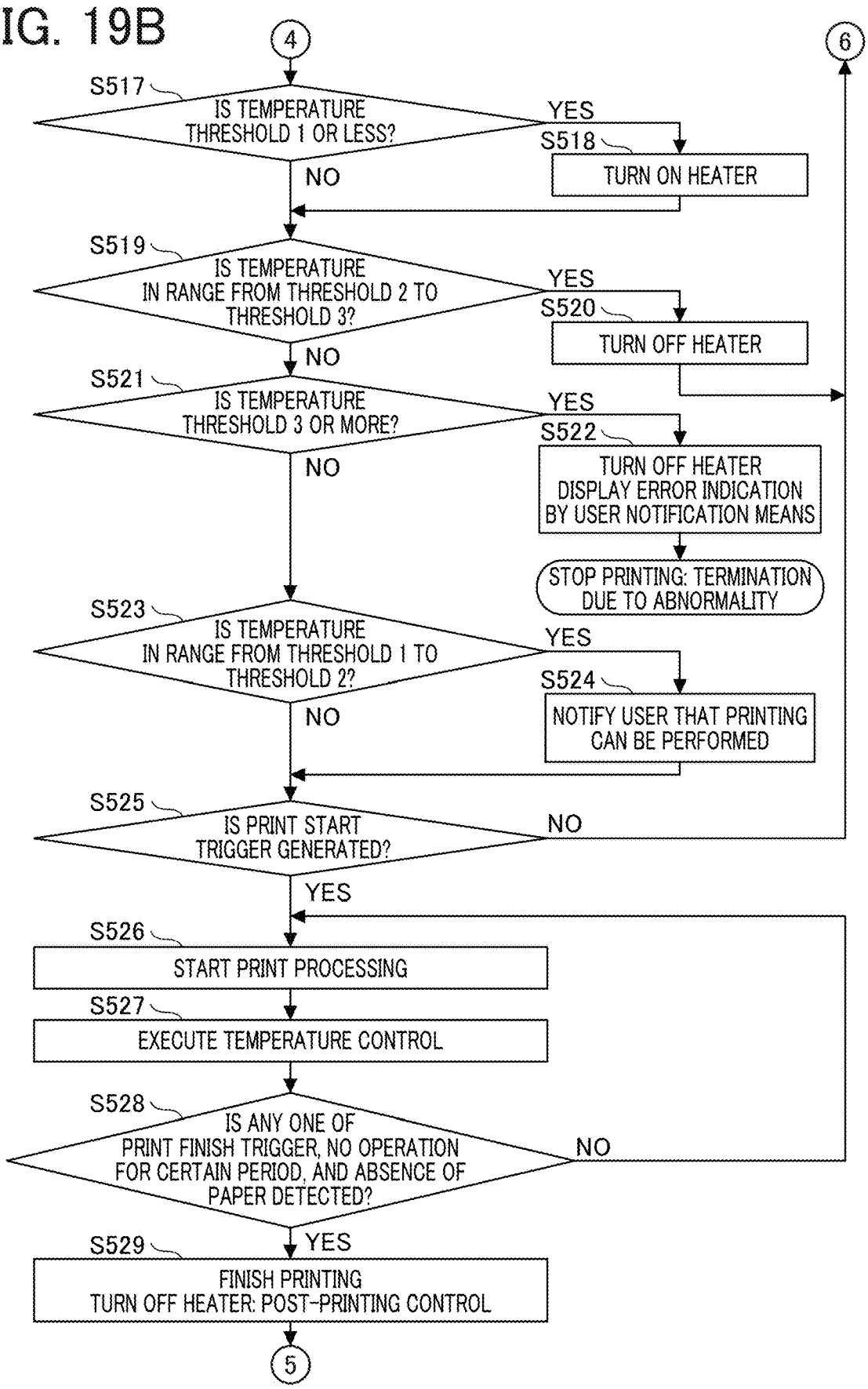

FIG. 19 is an enlarged perspective view of the printer 100, illustrating the vicinity of the front opening 55 in the removal state in which the front cover 50 and the photoconductor unit 40 are removed.

The body 20 accommodates a first joint 81, a second joint 82, and a third joint 83 that serve as joints or couplers that transmit a driving force to the photoconductor unit 40 that is removable. Those joints are coupled to a link lever 84 disposed in the body 20. In accordance with movement of the link lever 84 in a direction F in FIG. 19, the joints move in directions E in which the joints project from and retract to an interior face of the right wall 18*a* of the body 20.

Figure 20A:
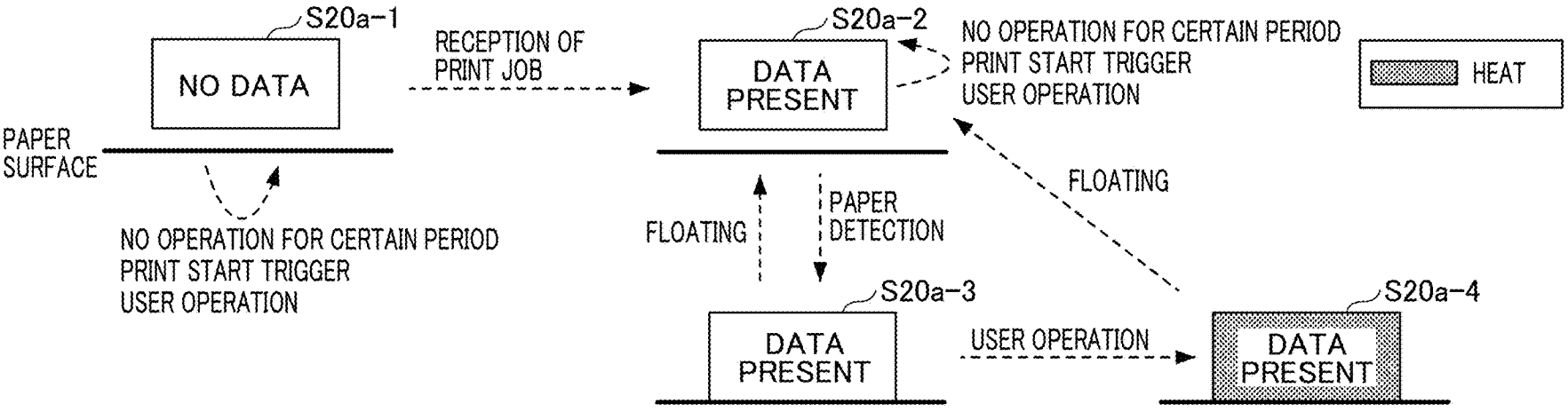
FIG. 20A is a perspective view of a driving unit incorporated in the printer depicted in FIG. 1 in an open state of the front cover.
Figure 20B:
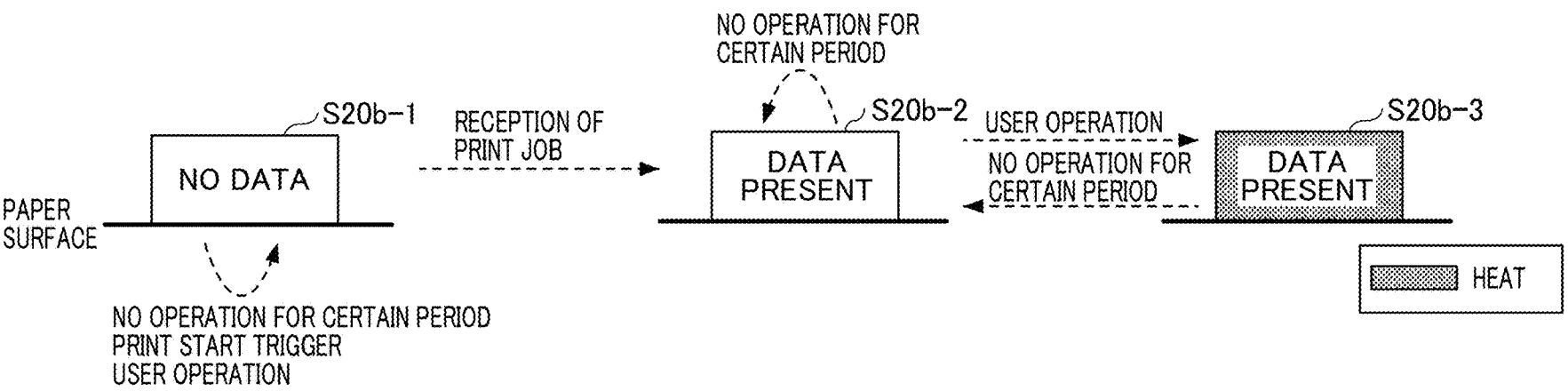
FIG. 20B is a perspective view of the driving unit depicted in FIG. 20A in a close state of the front cover.

FIGS. 20A and 20B are perspective views of a part of a driving unit 80 disposed within the right wall 18*a* of the body 20. The driving unit 80 includes the three joints (e.g., the first joint 81, the second joint 82, and the third joint 83) and the link lever 84. FIG. 20A is a perspective view of the driving unit 80 in the open state of the front cover 50. FIG. 20B is a perspective view of the driving unit 80 in the close state of the front cover 50.

A compression spring 85 biases the link lever 84 frontward in the body 20 in a direction F1 in FIG. 20A. Hence, when the link lever 84 is not exerted with an external force, as illustrated in FIG. 20A, the link lever 84 projects beyond a body of the driving unit 80. The three joints coupled to the link lever 84 retract in directions E1 in FIG. 20A.

Conversely, when the external force presses the link lever 84 in a direction F2 in FIG. 20B to retract the link lever 84, the link lever 84 is accommodated in the body of the driving unit 80. The three joints coupled to the link lever 84 project in directions E2 in FIG. 20B.

A description is provided of a relation between operation of the driving unit 80 and opening and closing of the front cover 50.

When the front cover 50 is opened, the driving unit 80 operates as illustrated in FIG. 20A. The link lever 84 projects beyond the body of the driving unit 80. The three joints retract within the right wall 18*a* of the body 20, being uncoupled to the photoconductor unit 40 and interrupting driving of the photoconductor unit 40.

Accordingly, the operator removes the photoconductor unit 40 from the body 20 and attaches the photoconductor unit 40 to the body 20 freely.

When the operator closes the front cover 50 that is opened, the link lever 84 positioned as illustrated in FIG. 20A is pressed rearward in the direction F2 in FIG. 20B by an interior wall face of the front cover 50 or a presser disposed on the interior wall face of the front cover 50. Accordingly, the link lever 84 is accommodated in the body of the driving unit 80 as illustrated in FIG. 20B. The three joints project beyond the interior face of the right wall 18*a* of the body 20 inward in the width direction, that is, the direction E2 in FIG. 20B. Thus, the three joints are coupled to the photoconductor unit 40 to drive the photoconductor unit 40.

When the driving unit 80 is in a driving state depicted in FIG. 20B, a driving force from a motor serving as a driver disposed in the body 20 is transmitted to the photoconductor unit 40, activating the printer 100.

When the driving unit 80 is in the driving state depicted in FIG. 20B, the compression spring 85 biases and presses the link lever 84 frontward in the body 20. A tip of the link lever 84 strikes and biases the front cover 50 frontward in the body 20.

As the operator presses the front cover 50 that is opened to close the front cover 50, the tip of the link lever 84 comes into contact with the back face of the front cover 50. As the operator presses the front cover 50 further, the front cover 50 presses the link lever 84 into the body of the driving unit 80 against a bias from the compression spring 85. The bias from the compression spring 85 presses the right portion of the front cover 50 frontward although the bias from the compression spring 85 does not press the left portion of the front cover 50. Accordingly, when the operator closes the front cover 50, the front cover 50 is subject to tilt such that the left portion of the front cover 50 is disposed at the rear position with respect to the body 20.

Like in the printer 100, with the construction in which the front cover 50 is subject to tilt such that one end of the front cover 50 in the width direction thereof is disposed at the rear position with respect to the body 20, the engagement assembly 16 disposed at another end of the front cover 50 in the width direction thereof, which is at a front position when the front cover 50 tilts, has the slide restriction face that is lengthened. Accordingly, the printer 100 may be intentionally configured to have a construction in which, when the operator closes the front cover 50, the front cover 50 is subject to tilt such that one end of the front cover 50 in the width direction thereof is disposed at the rear position.

For example, biasing members, such as the cover open biasing members 19*a* and 19*b*, that bias the closed, front cover 50 in the open direction to open the front cover 50 are disposed on the body 20 or the front cover 50. The biasing members apply different biases at a right end and a left end on the front cover 50, respectively, in the width direction thereof. The engagement assembly 16 disposed at one of the right end and the left end, which is applied with a greater bias, may have the slide restriction face that is lengthened.

With the construction incorporating the biasing members that bias the front cover 50 in the close state in the open direction, biases from the biasing members bring the hook side contact faces 124 of the lock hooks 12 into contact with the receiver side contact faces 133 of the hook receivers 13, respectively, thus positioning the front cover 50 with respect to the body 20. While the hook side contact faces 124 contact the receiver side contact faces 133, respectively, even if the biases are different between the right portion and the left portion of the front cover 50 in the width direction thereof, the front cover 50 barely tilts with respect to the body 20. As the operator presses the front cover release button 15 to release engagement between the lock hooks 12 and the hook receivers 13, the biases from the biasing members push the front cover 50. Even when the operator separates his or her hand from the front cover release button 15, locking by the lock hooks 12 and the hook receivers 13 remains being released.

As described above, with the construction incorporating the biasing members that bias the front cover 50, the biases from the biasing members are different between the right portion and the left portion of the front cover 50 in the width direction thereof. The slide restriction face of the engagement assembly 16 that receives a great bias from the biasing member is greater than the slide restriction face of the engagement assembly 16 that receives a small bias, which is smaller than the great bias, from the biasing member. Accordingly, while the engagement assemblies 16 suppress half closing of the front cover 50, the engagement assemblies 16 suppress upsizing of parts of one of the engagement assemblies 16 of which slide restriction face is less needed to be lengthened than the slide restriction face of another one of the engagement assemblies 16.

In the printer 100 according to the embodiments described above, the rod type slider 11 is combined with the two lock hooks 12. The rod type slider 11 and the two lock hooks 12 are made of an identical material.

Alternatively, the rod type slider 11 and the two lock hooks 12 may be separated from each other and made of different materials, respectively.

Figure 21:
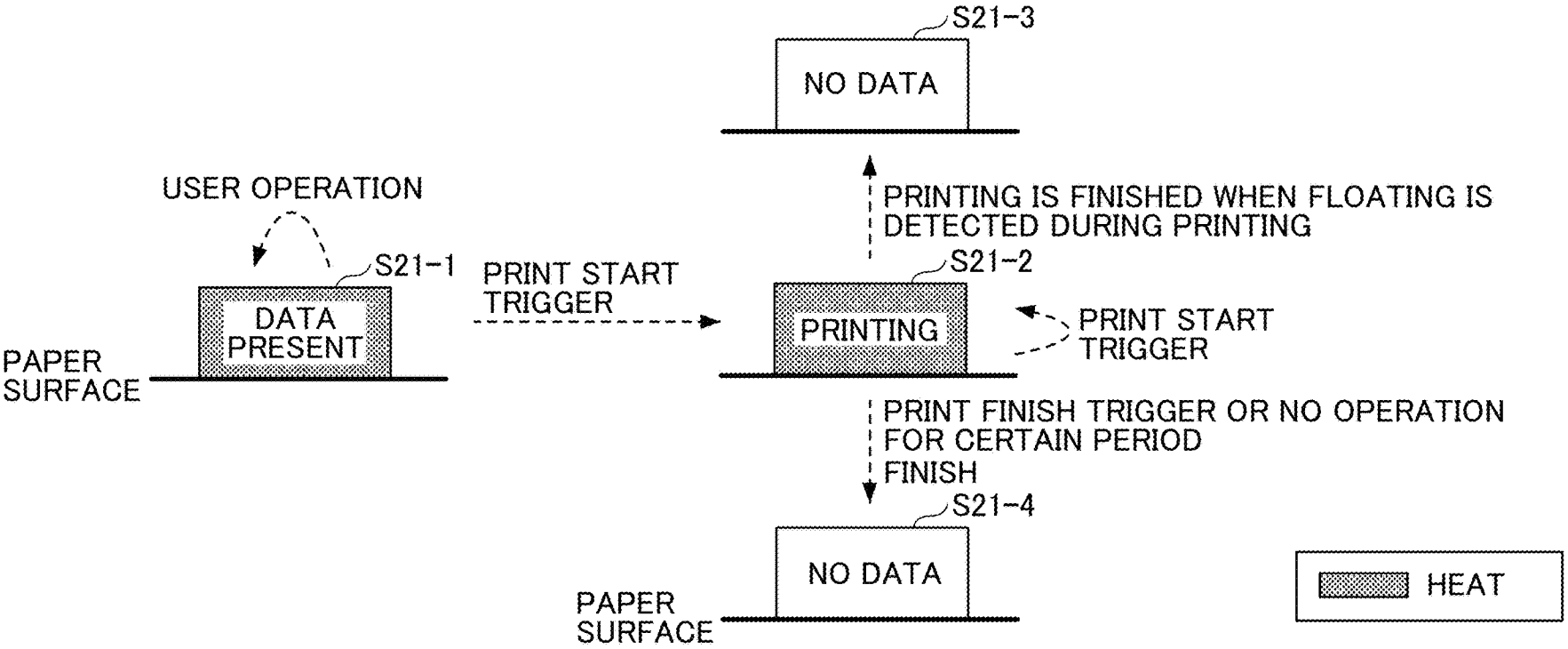
FIG. 21 is a diagram of the rod type slider and the lock hooks of the printers depicted in FIGS. 9 and 16.

FIG. 21 is a diagram of the rod type slider 11, the right lock hook 12*a*, and the left lock hook 12*b*. The rod type slider 11 is made of metal. The right lock hook 12*a* and the left lock hook 12*b* are made of resin. The rod type slider 11 depicted in FIG. 21 slides with respect to the front cover 50 and includes a shaft made of metal. The right lock hook 12*a* and the left lock hook 12*b* made of resin are mounted on a right portion and a left portion of the shaft, respectively.

Even if the front cover 50 is applied with forces that are directed in the close direction of the front cover 50 and are different between the right portion and the left portion of the front cover 50 in the width direction thereof, respectively, when the operator closes the front cover 50, the rod type slider 11 made of metal does not bend. Since the rod type slider 11 is free from bending, the rod type slider 11 prevents the right lock hook 12*a* and the left lock hook 12*b* from being displaced to different positions, respectively, with respect to the body 20 in the front-rear direction of the printer 100, thus suppressing half closing of the front cover 50.

According to the embodiments described above, as the spring 17 biases the rod type slider 11 rightward, the two lock hooks 12 mounted on the rod type slider 11, that is, the right lock hooks 12*a* and 12*a*S and the left lock hook 12*b*, slide together and engage the two hook receivers 13, that is, the right hook receivers 13*a* and 13*a*S and the left hook receiver 13*b*, respectively.

The construction that slides the two lock hooks 12 together in the engagement direction is not limited to the biasing member such as the spring 17. For example, a manual lever that slides the rod type slider 11 manually may be exposed to an outside of the front cover 50. After the operator such as the user moves the front cover 50 to the close state, the operator operates the manual lever to slide the two lock hooks 12 mounted on the rod type slider 11 in the engagement direction so that the two lock hooks 12 engage the two hook receivers 13, respectively.

However, if the operator is requested to slide the lock hooks 12 manually, the operator slides the rod type slider 11 manually after the operator closes the front cover 50, increasing the number of processes performed by the operator. Conversely, if the spring 17 is configured to slide the lock hooks 12 like in the embodiments described above, the operator merely closes the front cover 50 to engage the lock hooks 12 with the hook receivers 13, respectively. Accordingly, the number of processes performed by the operator is reduced, improving usability for the operator to close the front cover 50.

The front cover 50 serving as the opening-closing cover according to the embodiments described above is supported by the body 20 such that the front cover 50 is pivotable about the cover pivot shaft 50*a*. Alternatively, the opening-closing cover according to the embodiments described above may not be supported through a pivot shaft about which the opening-closing cover is pivotable.

For example, a cover side engagement (e.g., the lock hook 12) is mounted on one end of the front cover 50. Another end of the front cover 50 is fitted into a body (e.g., the body 20). The opening-closing cover pivots about the another end of the front cover 50 to engage the cover side engagement with a body side engagement (e.g., the hook receiver 13).

According to the embodiments described above, a cabinet including the opening-closing cover is a cabinet (e.g., the cabinet 90) of an image forming apparatus (e.g., the printer 100). Alternatively, the cabinet may be applied to an electronic device other than the image forming apparatus as long as the electronic device includes the opening-closing cover.

Yet alternatively, the cabinet may be applied to apparatuses and devices other than the electronic device as long as the apparatuses and the devices include the cabinet including the opening-closing cover.

The embodiments described above are examples and achieve advantages in aspects below.

A description is provided of an aspect 1.

As illustrated in FIGS. 9 and 17, a cabinet (e.g., the cabinet 90) includes a body (e.g., the body 20) and an opening-closing cover (e.g., the front cover 50). The opening-closing cover is openable and closable with respect to the body. When the opening-closing cover is closed, a cover side engagement (e.g., the right lock hooks 12*a* and 12*a*S) disposed on the opening-closing cover engages a body side engagement (e.g., the right hook receivers 13*a* and 13*a*S) disposed on the body to restrict opening or releasing of the opening-closing cover. The cabinet is an exterior cover of a printer (e.g., the printer 100), for example.

The cabinet further includes two engagement assemblies (e.g., the right engagement assemblies 16*a* and 16*a*S and the left engagement assembly 16*b*) each of which includes the cover side engagement and the body side engagement.

The cabinet further includes a slider (e.g., the rod type slider 11) that mounts the two cover side engagements and is slidable with respect to the opening-closing cover. As the slider slides in an engagement direction (e.g., the direction C or rightward in FIG. 9), the two cover side engagements engage the two body side engagements, respectively.

As illustrated in FIGS. 10 and 17, each of the two engagement assemblies includes a slide restriction face (e.g., the right hook side guide faces 123*a* and 123*a*S, the hook side guide face 123, the right receiver side guide faces 132*a* and 132*a*S, and the receiver side guide face 132) that is disposed on each of the cover side engagement and the body side engagement. When the cover side engagement is not at a position where the cover side engagement engages the body side engagement in an open-close direction of the opening-closing cover (e.g., a front-rear direction of the body 20), the restriction guide face prevents the cover side engagement from coming into contact with the body side engagement and prevents the slider from sliding in the engagement direction. The slide restriction face of at least one of the cover side engagement and the body side engagement of a first one of the two engagement assemblies (e.g., the right engagement assemblies 16*a* and 16*a*S) has a length that is greater than a length of the slide restriction face of a second one of the two engagement assemblies (e.g., the left engagement assembly 16*b*) in the open-close direction.

Accordingly, as described above in the embodiments, a simple construction in which the length of the slide restriction face of the first one of the two engagement assemblies is lengthened suppresses half closing of the opening-closing cover which occurs when the cover side engagement of the second one of the two engagement assemblies engages the body side engagement while the cover side engagement of the first one of the two engagement assemblies does not engage the body side engagement.

A description is provided of an aspect 2.

According to the aspect 1, as illustrated in FIG. 10, the length L1 of the slide restriction face (e.g., the right receiver side guide face 132*a*) of the body side engagement of the first one of the two engagement assemblies is greater than the length L2 of the slide restriction face (e.g., the right hook side guide face 123*a*) of the cover side engagement of the first one of the two engagement assemblies in the open-close direction.

Accordingly, as described above in the first embodiment, the cabinet suppresses half closing of the opening-closing cover which occurs when the cover side engagement of the second one of the two engagement assemblies engages the body side engagement while the cover side engagement of the first one of the two engagement assemblies does not engage the body side engagement.

A description is provided of an aspect 3.

According to the aspect 1 or 2, as illustrated in FIGS. 7 and 10, the length L1 of the slide restriction face of the body side engagement of the first one of the two engagement assemblies is greater than the length L1' of the slide restriction face (e.g., the receiver side guide face 132) of the body side engagement (e.g., the left hook receiver 13*b*) of the second one of the two engagement assemblies in the open-close direction.

Accordingly, as described above in the first embodiment, the cabinet suppresses half closing of the opening-closing cover which occurs when the cover side engagement of the second one of the two engagement assemblies engages the body side engagement while the cover side engagement of the first one of the two engagement assemblies does not engage the body side engagement.

The length of the slide restriction face of the body side engagement is different between the two engagement assemblies in accordance with tendency for the opening-closing cover to tilt relative to the open-close direction. Thus, the cabinet suppresses lengthening of the body side engagement of the second one of the two engagement assemblies of which slide restriction face is less needed to be lengthened.

Accordingly, the cabinet suppresses upsizing of parts of the body side engagement, reducing manufacturing costs and preventing degradation of usability for the operator while the opening-closing cover is opened.

A description is provided of an aspect 4.

According to the aspect 1, as illustrated in FIG. 17, the length L2 of the slide restriction face (e.g., the right hook side guide face 123*a*S) of the cover side engagement of the first one of the two engagement assemblies is greater than the length L1 of the slide restriction face (e.g., the right receiver side guide face 132*a*S) of the body side engagement of the first one of the two engagement assemblies in the open-close direction.

Accordingly, as described above in the second embodiment, the cabinet suppresses half closing of the opening-closing cover which occurs when the cover side engagement of the second one of the two engagement assemblies engages the body side engagement while the cover side engagement of the first one of the two engagement assemblies does not engage the body side engagement.

Additionally, the cabinet prevents a projection from being created in the body side engagement, preventing the body side engagement from disturbing operation of the operator when the operator replaces the photoconductor unit 40 with new one or removes a jammed sheet while the opening-closing cover is opened and thus facilitating operation of the operator.

A description is provided of an aspect 5.

According to the aspect 1 or 4, as illustrated in FIGS. 7 and 17, the length L2 of the slide restriction face (e.g., the right hook side guide face 123*a*S) of the cover side engagement of the first one of the two engagement assemblies is greater than the length L2' of the slide restriction face (e.g., the left hook side guide face 123) of the cover side engagement (e.g., the left lock hook 12*b*) of the second one of the two engagement assemblies in the open-close direction.

Accordingly, as described above in the second embodiment, the cabinet suppresses half closing of the opening-closing cover which occurs when the cover side engagement of the second one of the two engagement assemblies engages the body side engagement while the cover side engagement of the first one of the two engagement assemblies does not engage the body side engagement.

The length of the slide restriction face of the cover side engagement is different between the two engagement assemblies in accordance with tendency for the opening-closing cover to tilt relative to the open-close direction. Thus, the cabinet suppresses lengthening of the cover side engagement of the second one of the two engagement assemblies of which slide restriction face is less needed to be lengthened.

Accordingly, the cabinet suppresses upsizing of parts of the cover side engagement, reducing manufacturing costs and preventing degradation of usability for the operator while the opening-closing cover is opened.

A description is provided of an aspect 6.

According to any one of the aspects 1 to 5, as illustrated in FIG. 21, the slider includes a slide rod (e.g., the rod type slider 11) that supports the two cover side engagements. The slide rod includes a shaft made of metal.

Accordingly, as described in the embodiments, since the slide rod is free from bending, the slide rod prevents the two cover side engagements from being displaced to different positions, respectively, with respect to the body in the open-close direction, thus suppressing half closing of the opening-closing cover.

A description is provided of an aspect 7.

According to any one of the aspects 1 to 6, as illustrated in FIG. 9, the cabinet includes a biasing member (e.g., the spring 17) that biases the two cover side engagements in the engagement direction.

Accordingly, as described in the embodiments, when the operator closes the opening-closing cover, the biasing member facilitates operation of the operator.

A description is provided of an aspect 8.

As illustrated in FIGS. 2 and 9, an electronic device (e.g., the printer 100) includes an electronic part (e.g., an element of the image forming section 70) and the cabinet (e.g., the cabinet 90), such as an exterior cover that covers the electronic part, according to any one of the aspects 1 to 7.

Accordingly, as described in the embodiments, the cabinet suppresses half closing of the opening-closing cover of the electronic device.

A description is provided of an aspect 9.

As illustrated in FIG. 2, an image forming apparatus (e.g., the printer 100) that forms an image on a recording medium (e.g., a sheet P) includes the electronic device according to the aspect 8.

Accordingly, as described in the embodiments, the electronic device suppresses half closing of the opening-closing cover of the image forming apparatus.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A cabinet comprising:

a body;

an opening-closing cover to open and close with respect to the body in an open-close direction;

a first engagement assembly including:

a first body side engagement being disposed on the body and including a slide restriction face; and a first cover side engagement, disposed on the opening-closing cover, to engage the first body side engagement, the first cover side engagement including a slide restriction face;

a second engagement assembly including:

a second body side engagement being disposed on the body and including a slide restriction face; and a second cover side engagement, disposed on the opening-closing cover, to engage the second body side engagement, the second cover side engagement including a slide restriction face; and a slider, mounting the first cover side engagement and the second cover side engagement, to slide with respect to the opening-closing cover in an engagement direction so as to engage the first cover side engagement and the second cover side engagement with the first body side engagement and the second body side engagement, respectively, the slide restriction faces of the first cover side engagement and the second cover side engagement to come into contact with the slide restriction faces of the first body side engagement and the second body side engagement, respectively, to restrict sliding of the slider in the engagement direction when the first cover side engagement is not at a position where the first cover side engagement engages the first body side engagement in the open-close direction, the slide restriction face of at least one of the first body side engagement and the first cover side engagement having a length in the open-close direction that is greater than a length of the slide restriction face of other one of the first body side engagement, the first cover side engagement, the second body side engagement, and the second cover side engagement.

2. The cabinet according to claim 1, wherein the first cover side engagement and the second cover side engagement engage the first body side engagement and the second body side engagement, respectively, to restrict opening of the opening-closing cover when the opening-closing cover is closed.

3. The cabinet according to claim 1, wherein the length of the slide restriction face of the first body side engagement is greater than the length of the slide restriction face of the first cover side engagement in the open-close direction.

4. The cabinet according to claim 1, wherein the length of the slide restriction face of the first body side engagement is greater than the length of the slide restriction face of the second body side engagement in the open-close direction.

5. The cabinet according to claim 1, wherein the length of the slide restriction face of the first cover side engagement is greater than the length of the slide restriction face of the first body side engagement in the open-close direction.

6. The cabinet according to claim 1, wherein the length of the slide restriction face of the first cover side engagement is greater than the length of the slide restriction face of the second cover side engagement in the open-close direction.

7. The cabinet according to claim 1, wherein the slider includes a slide rod that supports the first cover side engagement and the second cover side engagement.

8. The cabinet according to claim 7, wherein the slide rod includes a shaft made of metal.

9. The cabinet according to claim 1, further comprising a biasing member to bias the slider in the engagement direction.

10. The cabinet according to claim 9, wherein the biasing member includes a spring.

11. The cabinet according to claim 1, wherein each of the first cover side engagement and the second cover side engagement further includes a hook.

12. The cabinet according to claim 1, wherein the first cover side engagement further includes a bent portion, and wherein the first body side engagement further includes a recess into which the bent portion of the first cover side engagement moves.

13. The cabinet according to claim 12, wherein the length of the slide restriction face of the first body side engagement is greater than a length of the bent portion of the first cover side engagement in the open-close direction.

14. An electronic device comprising:

an electronic part; and a cabinet that covers the electronic part, the cabinet including:

a body;

an opening-closing cover to open and close with respect to the body in an open-close direction;

a first engagement assembly including:

a first body side engagement being disposed on the body and including a slide restriction face; and a first cover side engagement, disposed on the opening-closing cover, to engage the first body side engagement, the first cover side engagement including a slide restriction face;

a second engagement assembly including:

a second body side engagement being disposed on the body and including a slide restriction face; and a second cover side engagement, disposed on the opening-closing cover, to engage the second body side engagement, the second cover side engagement including a slide restriction face; and a slider, mounting the first cover side engagement and the second cover side engagement, to slide with respect to the opening-closing cover in an engagement direction so as to engage the first cover side engagement and the second cover side engagement with the first body side engagement and the second body side engagement, respectively, the slide restriction faces of the first cover side engagement and the second cover side engagement to come into contact with the slide restriction faces of the first body side engagement and the second body side engagement, respectively, to restrict sliding of the slider in the engagement direction when the first cover side engagement is not at a position where the first cover side engagement engages the first body side engagement in the open-close direction, the slide restriction face of at least one of the first body side engagement and the first cover side engagement having a length in the open-close direction that is greater than a length of the slide restriction face of other one of the first body side engagement, the first cover side engagement, the second body side engagement, and the second cover side engagement.

15. An image forming apparatus comprising:

an image forming device to form an image on a recording medium; and a cabinet that covers the image forming device, the cabinet including:

a body;

an opening-closing cover to open and close with respect to the body in an open-close direction;

a first engagement assembly including:

a first body side engagement being disposed on the body and including a slide restriction face; and a first cover side engagement, disposed on the opening-closing cover, to engage the first body side engagement, the first cover side engagement including a slide restriction face;

a second engagement assembly including:

a second body side engagement being disposed on the body and including a slide restriction face; and a second cover side engagement, disposed on the opening-closing cover, to engage the second body side engagement, the second cover side engagement including a slide restriction face; and a slider, mounting the first cover side engagement and the second cover side engagement, to slide with respect to the opening-closing cover in an engagement direction so as to engage the first cover side engagement and the second cover side engagement with the first body side engagement and the second body side engagement, respectively, the slide restriction faces of the first cover side engagement and the second cover side engagement to come into contact with the slide restriction faces of the first body side engagement and the second body side engagement, respectively, to restrict sliding of the slider in the engagement direction when the first cover side engagement is not at a position where the first cover side engagement engages the first body side engagement in the open-close direction, the slide restriction face of at least one of the first body side engagement and the first cover side engagement having a length in the open-close direction that is greater than a length of the slide restriction face of other one of the first body side engagement, the first cover side engagement, the second body side engagement, and the second cover side engagement.

* * * * *